US011033091B2

(12) United States Patent
Wiesenthal et al.

(10) Patent No.: US 11,033,091 B2
(45) Date of Patent: Jun. 15, 2021

(54) DISPENSING SYSTEM

(71) Applicant: Serface Care, Inc., New York, NY (US)

(72) Inventors: Melanie Wiesenthal, Brooklyn, NY (US); Yael Eisele, Brooklyn, NY (US); Sina Sohrab, Brooklyn, NY (US); Joseph Guerra, Brooklyn, NY (US); Jesse Pliner, Brooklyn, NY (US); Greg Laptevsky, Brooklyn, NY (US); Steve Remy, Chicago, IL (US); Benjamin Harris Oppenheimer, New York, NY (US)

(73) Assignee: Serface Care, Inc., New York, NY (US)

( * ) Notice: Subject to any disclaimer, the term of this patent is extended or adjusted under 35 U.S.C. 154(b) by 136 days.

(21) Appl. No.: 16/542,586

(22) Filed: Aug. 16, 2019

(65) Prior Publication Data

US 2020/0054110 A1 Feb. 20, 2020

Related U.S. Application Data

(60) Provisional application No. 62/859,748, filed on Jun. 11, 2019, provisional application No. 62/719,749, filed on Aug. 20, 2018.

(51) Int. Cl.
*B43K 5/06* (2006.01)
*A45D 40/04* (2006.01)
(Continued)

(52) U.S. Cl.
CPC ..... *A45D 40/04* (2013.01); *A45D 40/06* (2013.01); *A45D 40/065* (2013.01); *A45D 40/14* (2013.01);
(Continued)

(58) Field of Classification Search
CPC ..... A45D 40/04; A45D 40/06; A45D 40/065; A45D 40/14; A45D 40/16; A45D 40/205; A45D 2040/208
(Continued)

(56) References Cited

U.S. PATENT DOCUMENTS 4,013,370 A 3/1977 Gingras
4,363,560 A 12/1982 Gentile
(Continued)

OTHER PUBLICATIONS

Derek Lakin, Helmm Deodorant Reviews, https://www.highya.com/helmm-deodorant-reviews, Aug. 27, 2018, 6 pgs.
(Continued)

*Primary Examiner* — Jennifer C Chiang
(74) *Attorney, Agent, or Firm* — Brad M. Behar & Associates, PLLC

(57) ABSTRACT

A deodorant dispensing system is provided. The system includes a reusable deodorant case having a body and a dial rotatably coupled to the body. The body is structured to receive a replaceable deodorant cartridge containing an unused deodorant puck. Operation of the dial along a predetermined rotational direction causes the deodorant puck to dispense for application by a user, whereas operation of the dial along a rotational direction opposite to the predetermined rotational direction causes the deodorant puck to retract within the deodorant cartridge. Operation of the dial in a direction to retract the deodorant puck after the deodorant puck it is fully retracted causes the dial to rotate freely with respect to the body without causing damage to internal components of the deodorant dispensing system.

22 Claims, 32 Drawing Sheets

(51) Int. Cl.

| | |
|---|---|
| ***A45D 40/16*** | (2006.01) |
| ***A45D 40/14*** | (2006.01) |
| ***A45D 40/06*** | (2006.01) |
| *A45D 40/00* | (2006.01) |
| *A45D 40/20* | (2006.01) |

(52) U.S. Cl.
CPC ..... *A45D 40/16* (2013.01); *A45D 2040/0043* (2013.01); *A45D 2040/0062* (2013.01); *A45D 2040/208* (2013.01)

(58) Field of Classification Search
USPC ..... 401/175
See application file for complete search history.

(56) References Cited

U.S. PATENT DOCUMENTS

| | | | | |
|---|---|---|---|---|
| 5,437,513 | A | 8/1995 | Favre | |
| 5,529,416 | A | 6/1996 | Favre | |
| 7,789,582 | B2 * | 9/2010 | Babel | A45D 40/26 401/175 |
| 8,388,249 | B2 | 3/2013 | Groh et al. | |
| 8,851,779 | B2 * | 10/2014 | Jimenez | A46B 11/0065 401/277 |
| 10,743,636 | B2 * | 8/2020 | Bushell | A45D 40/04 |
| 2002/0006305 | A1 | 1/2002 | Petit et al. | |
| 2007/0147948 | A1 * | 6/2007 | Murakoshi | A45D 40/04 401/175 |
| 2008/0050168 | A1 | 2/2008 | Groh et al. | |
| 2018/0295968 | A1 | 10/2018 | Groffsky et al. | |

OTHER PUBLICATIONS

International Preliminary Report on Patentability dated Feb. 23, 2021 from PCT/US19/46976 and the accompanying Written Opinion of the International Searching Authority dated Jan. 21, 2020.

* cited by examiner

DISPENSING SYSTEM

CROSS REFERENCE

This application claims the benefit of U.S. Provisional Application Ser. No. 62/719,749 filed on Aug. 20, 2018 and U.S. Provisional Application Ser. No. 62/859,748 filed on Jun. 11, 2019, each which is expressly incorporated herein in its entirety by reference thereto.

FIELD OF INVENTION

The present invention relates to dispensing cases and products and, in particular, deodorant dispensing products having replaceable deodorant cartridges.

BACKGROUND OF THE INVENTION

It is believed that disposable deodorant products have been widely available since the emergence of plastic compounds in the late 1900s. A large number of these products are comprised of either a plastic rollerball set into a plastic cylinder to dispense a liquid deodorant or a threaded, plastic spindle set into a plastic cylinder to extend a solid deodorant puck via turning of a dial. Such deodorant products are typically not reusable, requiring users to dispose of them when they deplete of deodorant. Such disposal negatively impacts the environment, is uneconomical and leads to substantial waste, both during the manufacturing process and by the end user. While manufacturers have developed reusable deodorant cases with replaceable deodorant cartridges, there is a need for a simpler design that permits easy installation and removal of deodorant cartridges from deodorant cases. There is also a need for a reusable deodorant system that prevents damage to internal components that may otherwise occur from over extension or retraction of the deodorant. There is also a need for a reusable deodorant case with an easy to use and reliable closure system for the system's cap/cover, a case that can be used to dispense other materials such as, for example, soap, glue, etc.

SUMMARY OF THE INVENTION

Applicant has invented new and useful systems for dispensing a product (such as a deodorant, lipstick, soap, perfume, glue stick, solid paint stick, a cleaning product, etc.) using cases and replaceable cartridges that may be easily inserted into and removed from the cases. The inventive systems described herein reduce waste and costs by allowing users to retain cases and purchase cartridges for a lower price compared to currently available disposable products. They also provide users with flexibility by allowing for the purchase of multiple cartridges having different attributes and/or other properties (such as different scents for disposable deodorant cartridges). This may be particularly advantageous when multiple users of the dispensing systems, such as multiple members of a family, desire different attributes or properties of a cartridge (such as different deodorants with respect to deodorant cartridges), or when a single user desires to use different cartridges at different times. Embodiments of the present invention also provide a mechanism whereby internal components of cases and/or cartridges may be protected from damage that would otherwise occur when a user attempts to extend a product too far out of a case or retract the product to far into the case, such as, for example, when a user finishes application of a deodorant.

In accordance with one embodiment of the present invention, the system includes a reusable deodorant case including a body having a distal end and an inner surface provided with at least one longitudinally extending cartridge-receipt groove, and a dial rotatably coupled to the distal end of the body. The system also includes a deodorant cartridge including a sleeve removeably positioned within the body of the deodorant case and having a distal end, a proximal end, a longitudinal length, an outer surface and an inner surface, the outer surface of the sleeve being provided with at least one guiding rail for slideably mating with the at least one cartridge-receipt groove on the inner surface of the case body, the inner surface of the sleeve being provided with at least one guiding groove extending longitudinally from the distal end of the sleeve to a terminating end of the at least one guiding groove, a length of the at least one guiding groove being less than the longitudinal length of the sleeve; a solid deodorant puck positioned within the sleeve; a platform having a longitudinal bore provided with bore threads and at least one projecting tab for slideably mating with the at least one guiding groove of the sleeve; a bottom cap having a longitudinal bore, the bottom cap being coupled to the distal end of the sleeve, and a cylindrical spindle having an outer surface provided with surface threads and an operating end removably coupled to the dial of the deodorant case, the spindle extending through the longitudinal bore of the platform and the longitudinal bore of the bottom cap, the surface threads of the spindle screwably engaging the bore threads of the platform. When the dial of the case is rotated along a first rotational direction, the platform is advanced toward the proximal end of the sleeve to raise or dispense the deodorant puck upwardly until the at least one tab of the platform contacts the terminal end of the at least one guiding groove of the sleeve. Further rotation of the dial along the same direction after the at least one tab of the platform contacts the terminal end of the at least one guiding groove of the sleeve operates to at least partially eject the deodorant cartridge from the body of the deodorant case.

In accordance with another embodiment of the present invention, a removeable cover is positioned over the proximal end of the sleeve covering the deodorant puck.

In accordance with yet another embodiment of the present invention, the outer surface of the sleeve is provided with at least one engagement rib and the inner surface of the body is provided with at least one mating rib structured to snap-fit with the at least one engagement rib for removeably maintaining the deodorant cartridge within the body.

In accordance with still another embodiment of the present invention, the reusable deodorant case further includes a positioning member fixedly coupled to the distal end of the body and enclosed by the dial, the positioning member being structured to bias the dial into a plurality of discrete rotational positions when the dial is rotated.

In accordance with yet another embodiment of the present invention, the positioning member includes at least one detent and at least one leaf-spring coupled to the at least one detent, and the dial includes an inner surface provided with a plurality of circumferentially positioned receptacles. The at least one leaf-spring is structured to bias the at least one detent into a first one of the receptacles to position the dial into a first one of the plurality of discrete rotational positions, and an inner surface of the first receptacle is structured to compress the leaf-spring when the dial is rotated to advance a second one of the receptacles to the detent, thereby positioning the dial into a second one of the plurality of discrete rotational positions.

In accordance with still another embodiment of the present invention, the at least one detent is convex in shape and each of the plurality of receptacles is concave in shape.

In accordance with yet another embodiment of the present invention, interaction of the at least one detent with the plurality of receptacles produces a clicking sound when the dial is rotated.

In accordance with still another embodiment of the present invention, the deodorant dispensing system further includes a top cap removeably coupled to a proximal end of the body of the deodorant case.

In accordance with yet another embodiment of the present invention, the top cap has an inner surface provided with a plurality of channels and the proximal end of the outer surface of the body is provided with a respective plurality of protrusions for slideably engaging the plurality of channels. The plurality of protrusions are advanced within the plurality of channels to bias the top cap in a closed position when the top cap is rotated along a second rotational direction, and the plurality of protrusions are retreated from the plurality of channels for removal of the top cap from the body when the top cap is rotated along the same direction.

In accordance with still another embodiment of the present invention, a deodorant dispensing system is provided. The system includes a reusable deodorant case including a body having a distal end and an inner surface provided with at least one mating groove, a dial rotatably coupled to the distal end of the body, the dial including a clutch receipt structure, and a clutch positioned within the clutch receipt structure of the dial, the clutch including a spindle receipt structure. The system also includes a deodorant cartridge including a sleeve removeably positionable within the body of the deodorant case and having a distal end, a proximal end, a longitudinal length, an outer surface, an inner surface and a gripping rail, the outer surface of the sleeve being provided with at least one guiding tab for mating with the at least one mating groove of the body, the inner surface of the sleeve being provided with at least one guiding rail extending longitudinally from the distal end of the sleeve to a terminating widened stopper, a length of the at least one guiding rail being less than the longitudinal length of the sleeve, a deodorant puck positioned within the sleeve, a platform having a longitudinal bore provided with bore threads and at least one guiding groove for slideably mating with the at least one guiding rail of the sleeve, a bottom cap having a longitudinal bore, the bottom cap being coupled to the distal end of the sleeve, and a spindle having an outer surface provided with surface threads, an operating end structured to removeably couple to the spindle receipt structure of the clutch, and an operating disc formed integrally with the operating end, the spindle extending through the longitudinal bore of the platform and the longitudinal bore of the bottom cap, the surface threads of the spindle screwably engaging the bore threads of the platform. When the deodorant cartridge is properly inserted within the body of the deodorant case, rotation of the dial along a first predetermined rotational direction operates to advance the platform toward the proximal end of the sleeve to dispense the deodorant puck, and rotation of the dial along a rotational direction opposite to the first predetermined rotational direction operates to retract the platform toward the distal end of the sleeve to retract the deodorant puck.

In accordance with yet another embodiment of the present invention, a removeable cover is positioned over the proximal end of the sleeve for covering the deodorant puck, the removable cover including a lip to facilitate easy gripping by a user.

In accordance with still another embodiment of the present invention, the at least one guiding tab of the sleeve is advanced within the at least one mating grove of the body to bias the deodorant cartridge in an inserted position when the deodorant cartridge is rotated along a second rotational direction, and the at least one guiding tab of the sleeve is retreated from the at least one mating grove of the body for removal of the deodorant cartridge from the body when the deodorant cartridge is rotated along a direction opposite to the second rotational direction.

In accordance with yet another embodiment of the present invention, when the platform is retracted fully toward the distal end of the sleeve and the dial is rotated along a rotational direction opposite to the first predetermined rotational direction, the clutch is structured to cause the dial to rotate freely with respect to the body and without causing rotation of the spindle.

In accordance with still another embodiment of the present invention, the clutch includes at least one biasing leaf having a clutch tab and the clutch receipt structure of the dial includes at least one dial rib, the dial rib engaging the clutch tab when the dial is rotated.

In accordance with yet another embodiment of the present invention, when the platform is retracted fully toward the distal end of the sleeve and the dial is rotated along a rotational direction opposite to the first predetermined rotational direction, the dial rib urges biasing leafs inwardly toward a center of the clutch until the clutch tab clears the dial rib, thereby permitting free rotation of the dial.

DETAILED DESCRIPTION

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import. "About" as used herein when referring to a measurable value such as an amount, a temporal duration, and the like, is meant to encompass variations from the specified value, as such variations are appropriate.

Figure 1:
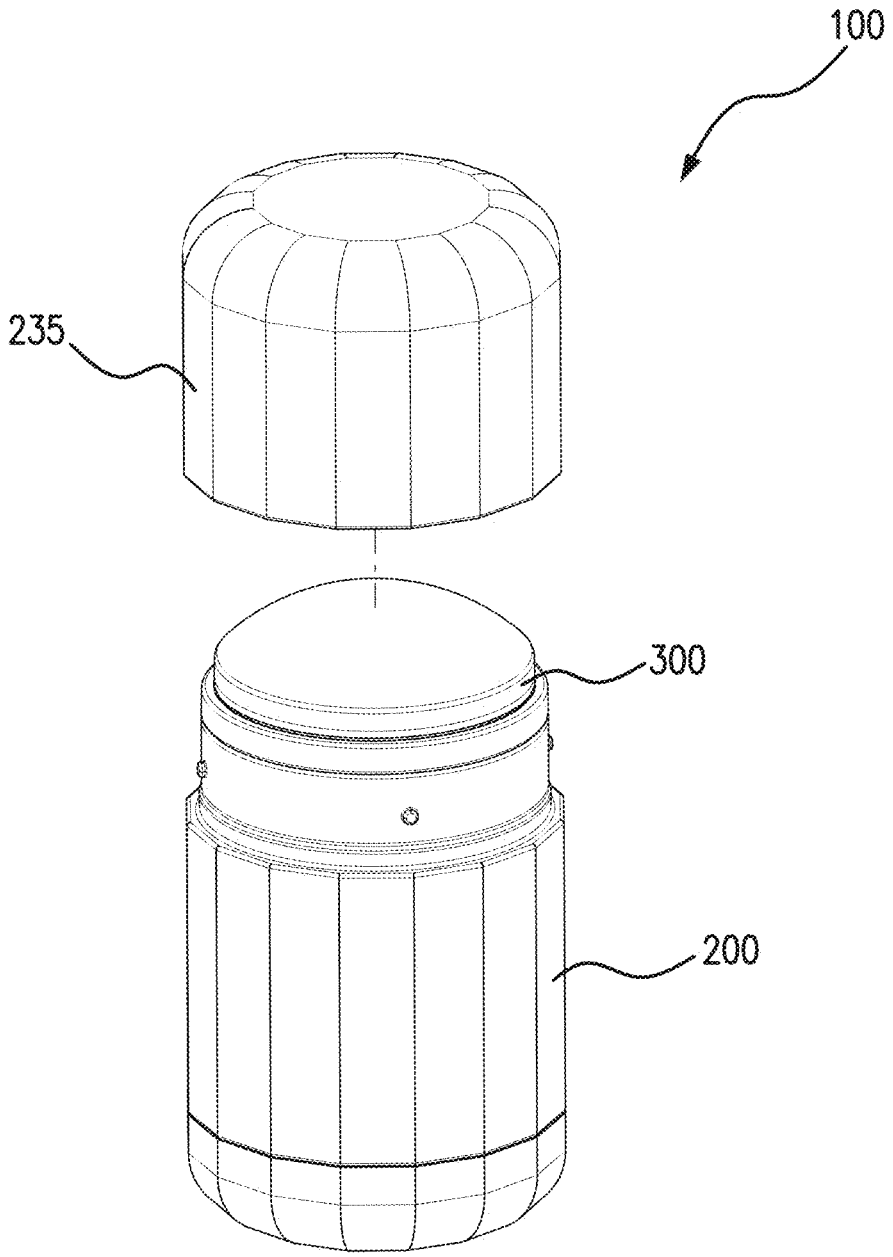
FIG. 1 shows a perspective view of a deodorant dispensing system according to the present invention with a top cap removed.

Referring now to FIG. 1, there is seen a perspective view of an exemplary deodorant dispensing system 100 according to the present invention. Dispensing system 100 includes reusable deodorant case 200 (with top cap 235) and replaceable stick deodorant cartridge 300. Deodorant dispensing system 100 is operable to dispense a deodorant puck for application by a user.

Figure 2A:
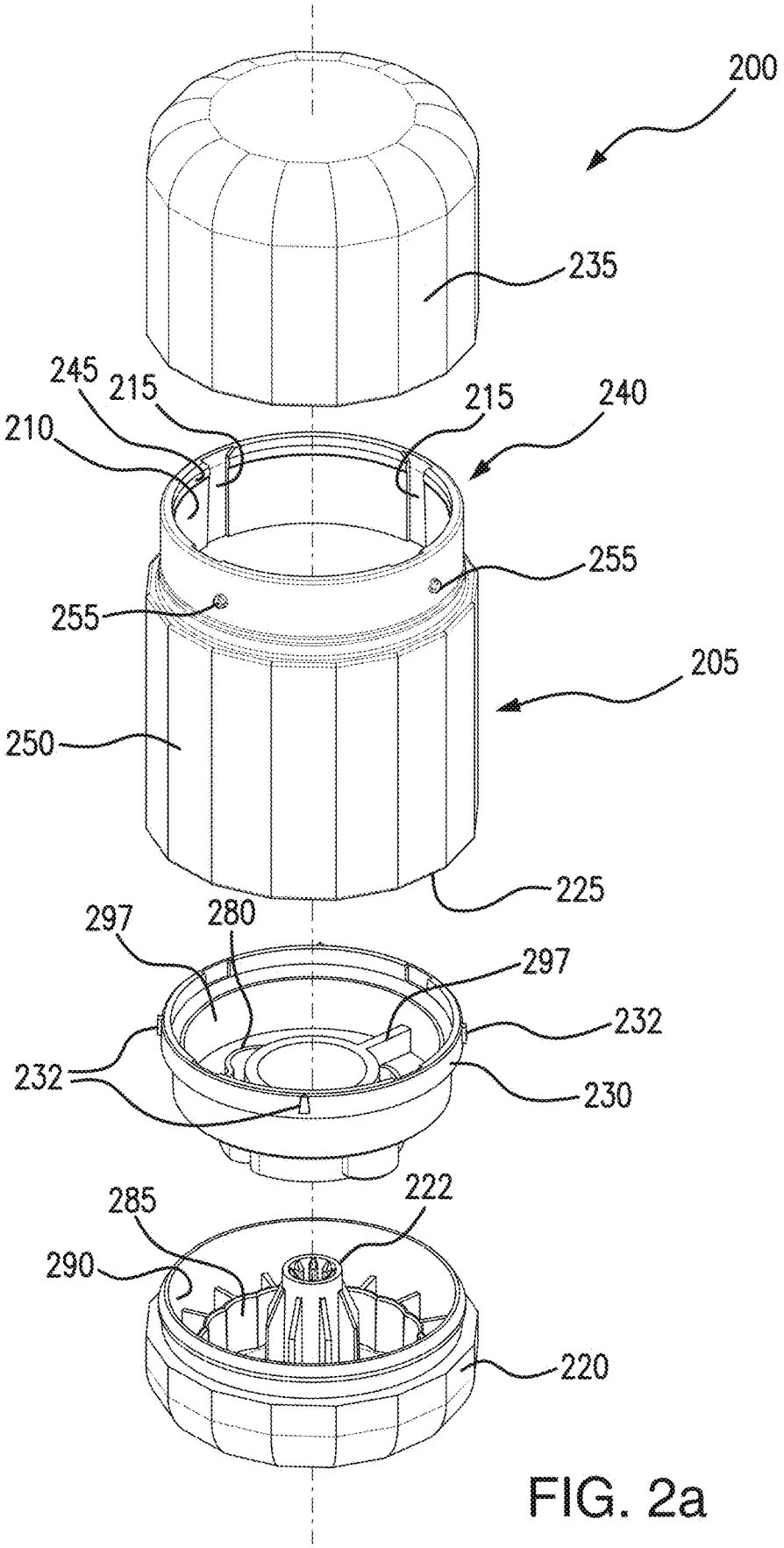
FIG. 2*a* shows an exploded view of a reusable deodorant case according to the present invention.
Figure 2B:
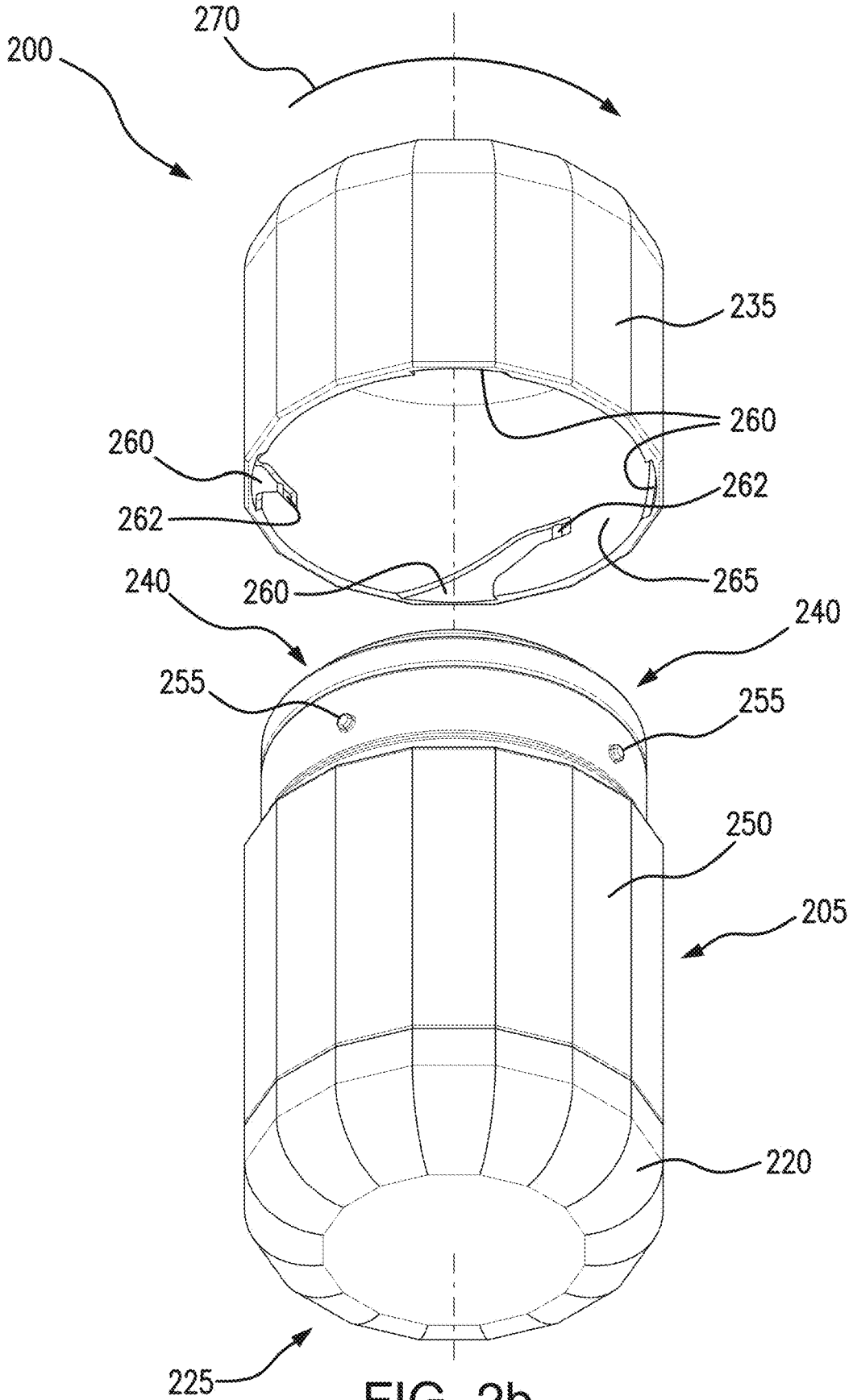
FIG. 2*b* shows a different partially exploded view of the reusable deodorant case shown in FIG. 2*a*.
Figure 2C:
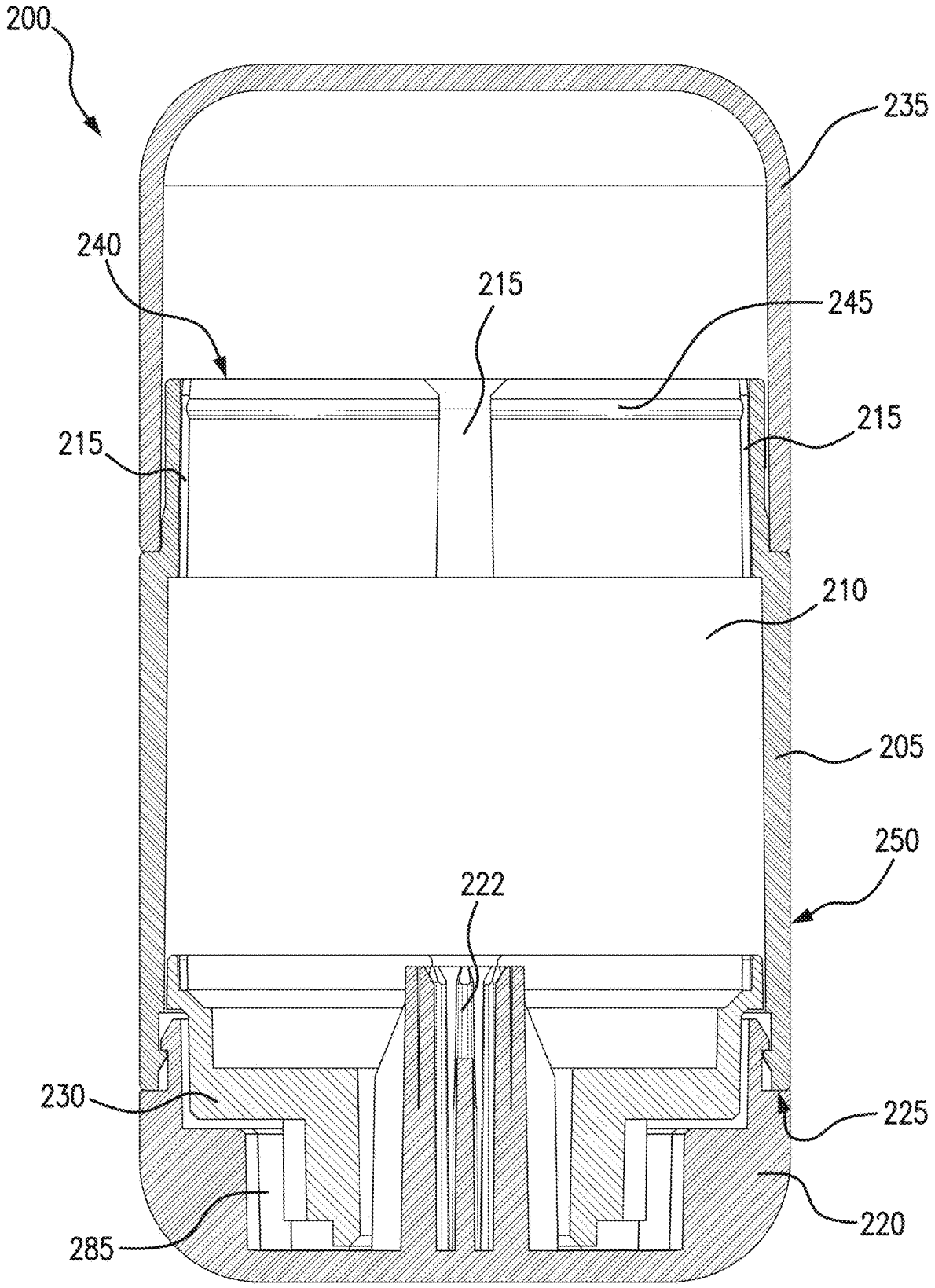
FIG. 2*c* shows a sectional view of the reusable deodorant case shown in FIG. 2*a*.
Figure 2D:
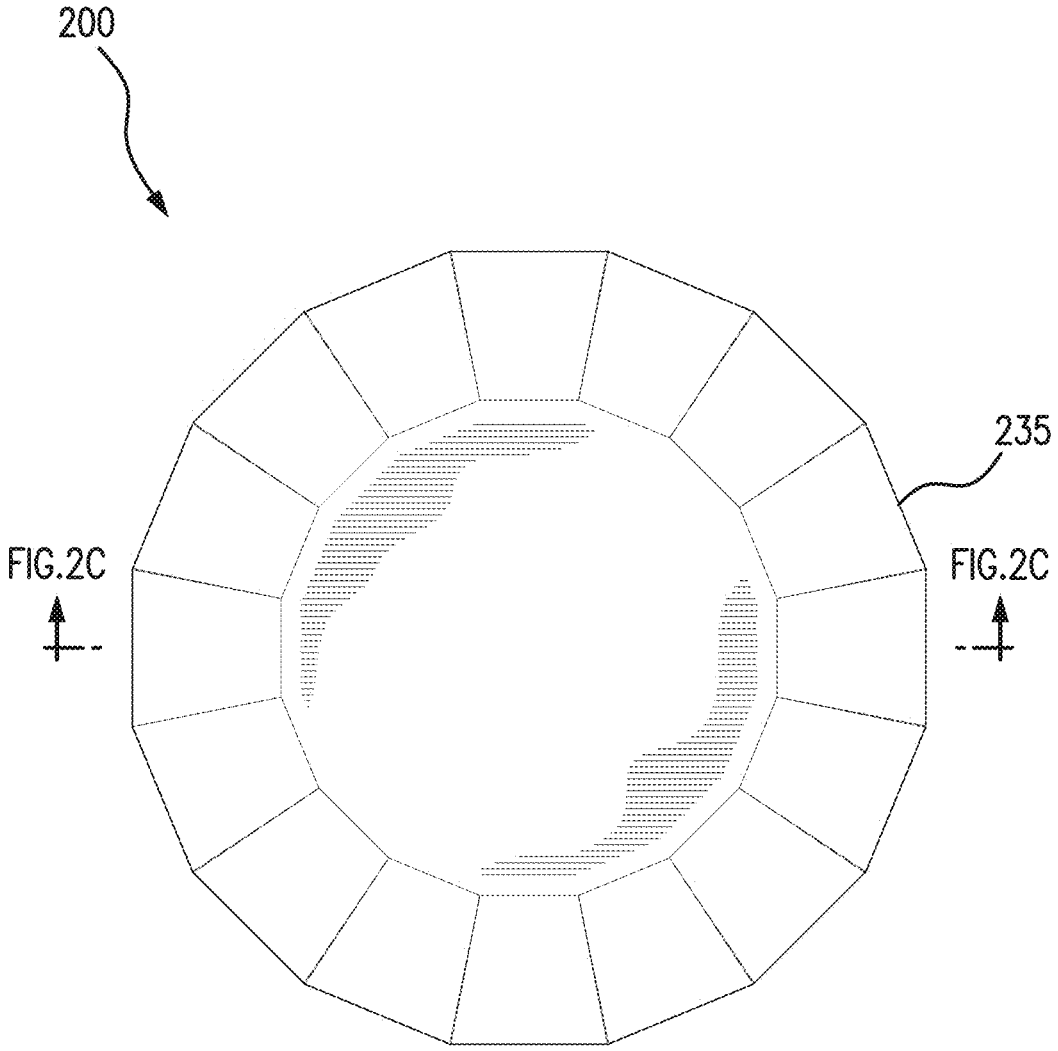
FIG. 2*d* shows a top view of the reusable deodorant case shown in FIG. 2*a*.

Referring now to FIGS. 2*a* though 2*d*, there is seen various views of an exemplary reusable deodorant case 200 in accordance with the present invention. Case 200 includes a body 205, a positioning member 230 positioned at distal end 225 of body 205, a dial 220 with a spindle receipt structure 222 rotatably coupled to distal end 225 and enclosing positioning member 230, and a removeable top cap 235 coupled to proximal end 240 of body 205.

Inner surface 210 of body 205 is provided with cartridge-receipt grooves 215 and mating grooves 245 for receiving and maintaining deodorant cartridge 300 within body 205. Outer surface 250 of body 205 is provided with protrusions 255 structured to mate with respective channels 260 provided on inside surface 265 of top cap 235. When protrusions 255 are mated with channels 260, rotation of top cap 235 along predetermined rotational direction 270 causes protrusions 255 to advance within channels 260 and snap-fit with stopper tabs 262 to bias top cap 235 in a closed position, whereas rotation of top cap 235 in the opposite rotational direction causes protrusions 255 to retreat from channels 260 for removal of top cap 235 from body 205. Alternate closure mechanisms to bias the top cap 235 in a closed position on the proximal end of the body 205, such as threads, tabs, grooves, and combinations thereof, may used, all which are included within the scope of the invention. Body 205 and/or top cap 235 may also be provided with a sealing feature, such as a ring of rubber or other suitable structure and/or material (not shown), for forming a seal between body 205 and top cap 235 when top cap 235 is rotated into the closing position. In another embodiment, outer surface 250 of body 205 is provided with one or more features to improve grip, such as texturing, rubbering, etc. (not shown).

Figure 2E:
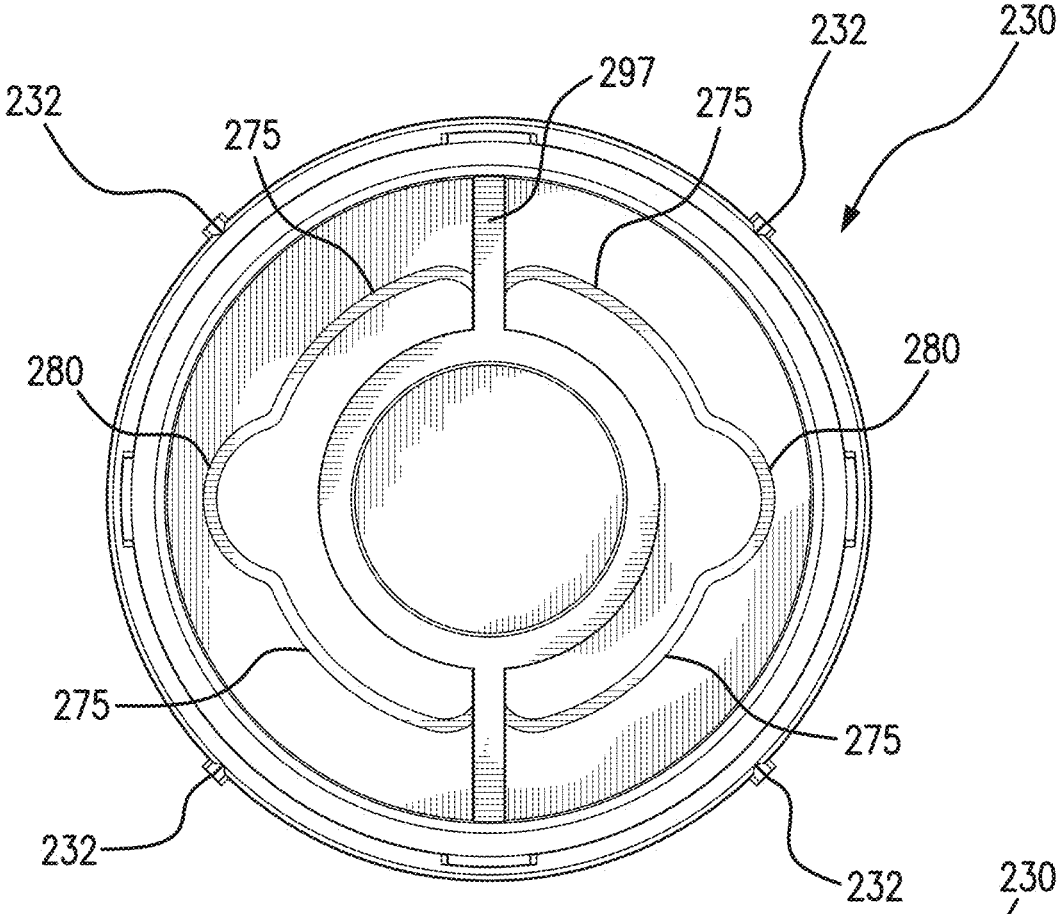
FIG. 2*e* shows a top view of a positioning member according to the present invention.
Figure 2F:
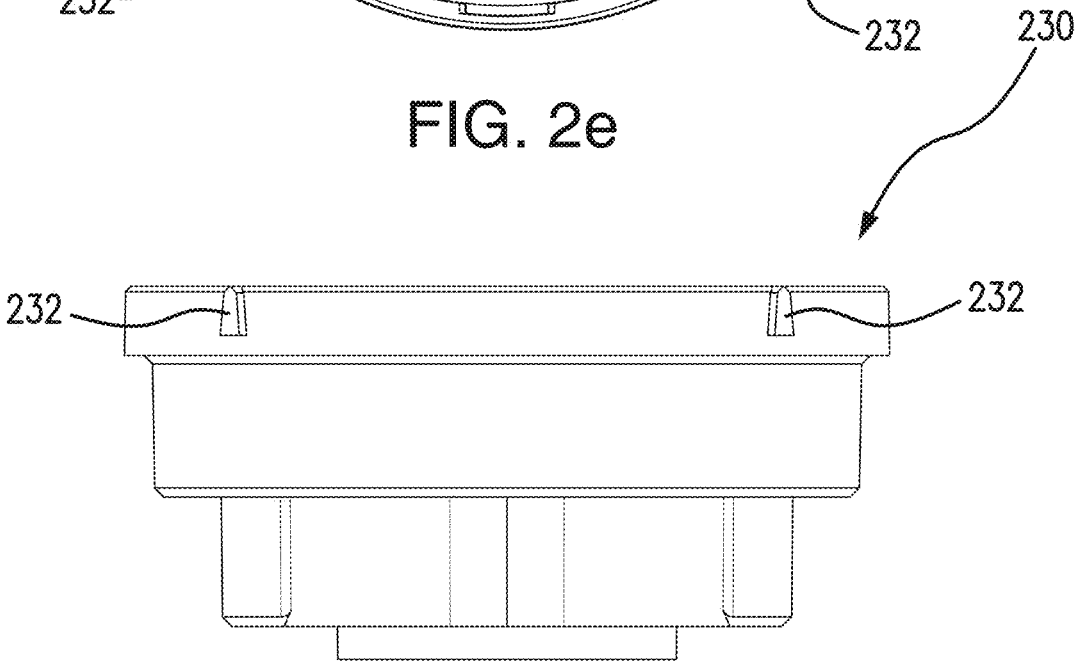
FIG. 2*f* shows a side view of the positioning member shown in FIG. 2*e*.
Figure 2G:
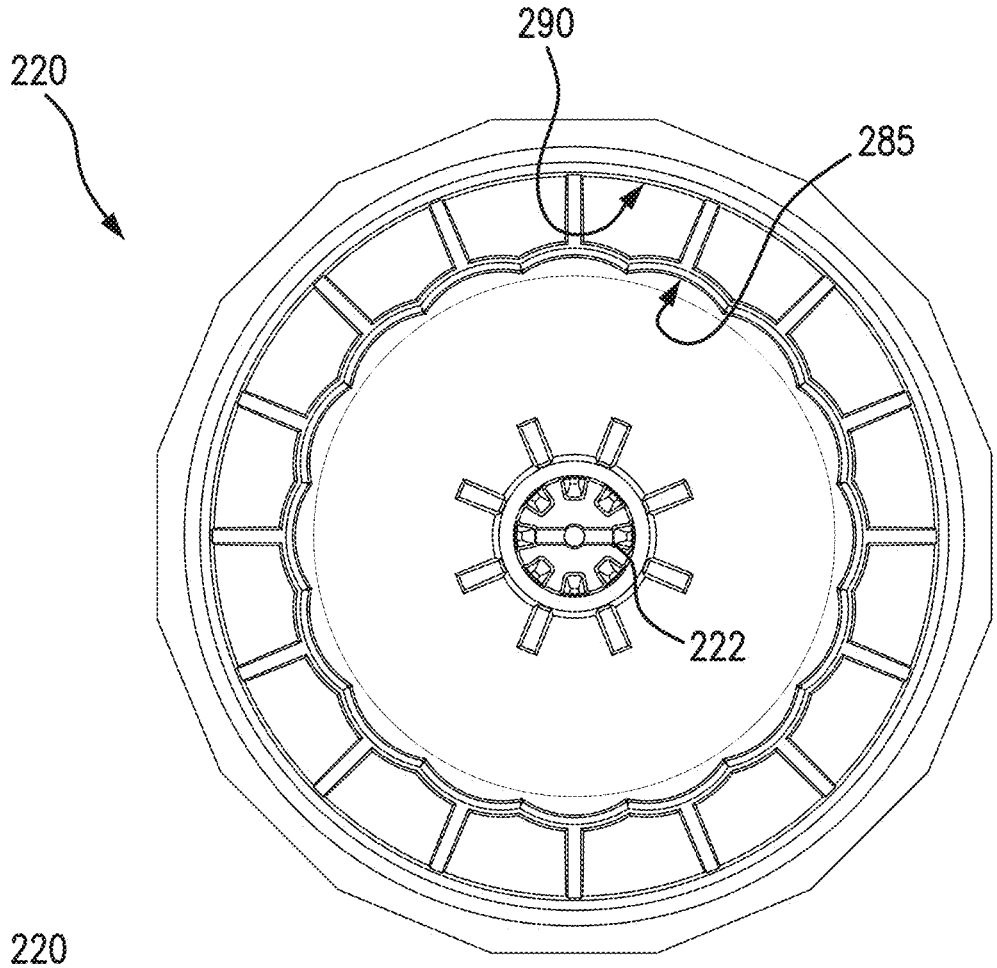
FIG. 2*g* shows a top view of a case dial according to the present invention.
Figure 2H:
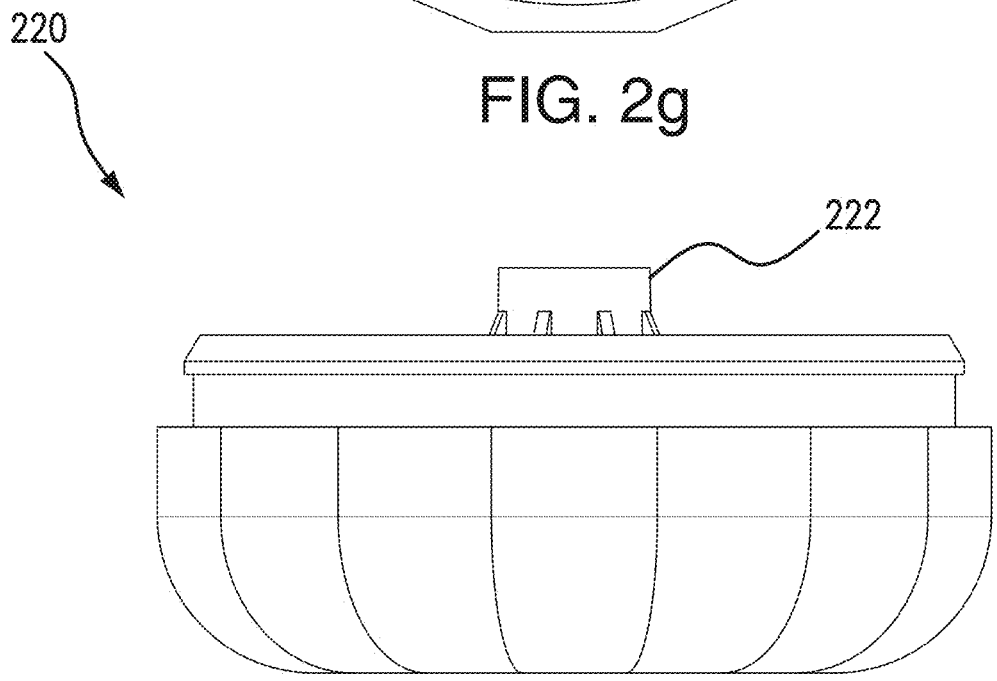
FIG. 2*h* shows a side view of the case dial shown in FIG. 2*g*.

Referring now to FIGS. 2*e* and 2*f*, there is seen top and side views of positioning member 230. Positioning member 230 is fixedly coupled to distal end 225 of body 205. Guiding tabs 232 mate with respective receipt grooves (not shown) on inner surface 210 of body 205 to provide proper orientation of positioning member 230. Positioning member 230 includes leaf-springs 275 fixed to a support structure 297 and detents 280 positioned at the end of leaf-springs 275. Leaf-springs 275 bias detents 280 into an opposing pair of receptacles 285 positioned around inner surface 290 of dial 220 (see FIGS. 2*g* and 2*h* showing top and side views of dial 220). Upon rotation of dial 220 with respect to body 205, the receptacles 285 receiving detents 280 compress leaf-springs 275, thereby displacing detents 280 toward the center of support structure 297 and advancing an adjacent pair of receptacles 285 to detents 280. In this manner, positioning member 230 operates to permit dial 220 to be rotated into multiple discrete rotational positions. In one embodiment, leaf-springs 275 and/or detents 280 are structured such that detents 280 and receptacles 285 interact to make a "clicking" sound when dial 220 is rotated into different rotational positions. These embodiments permit deodorant dispensing system 100 to provide tactile and audible feedback and, more generally, a better user experience.

Figure 3A:
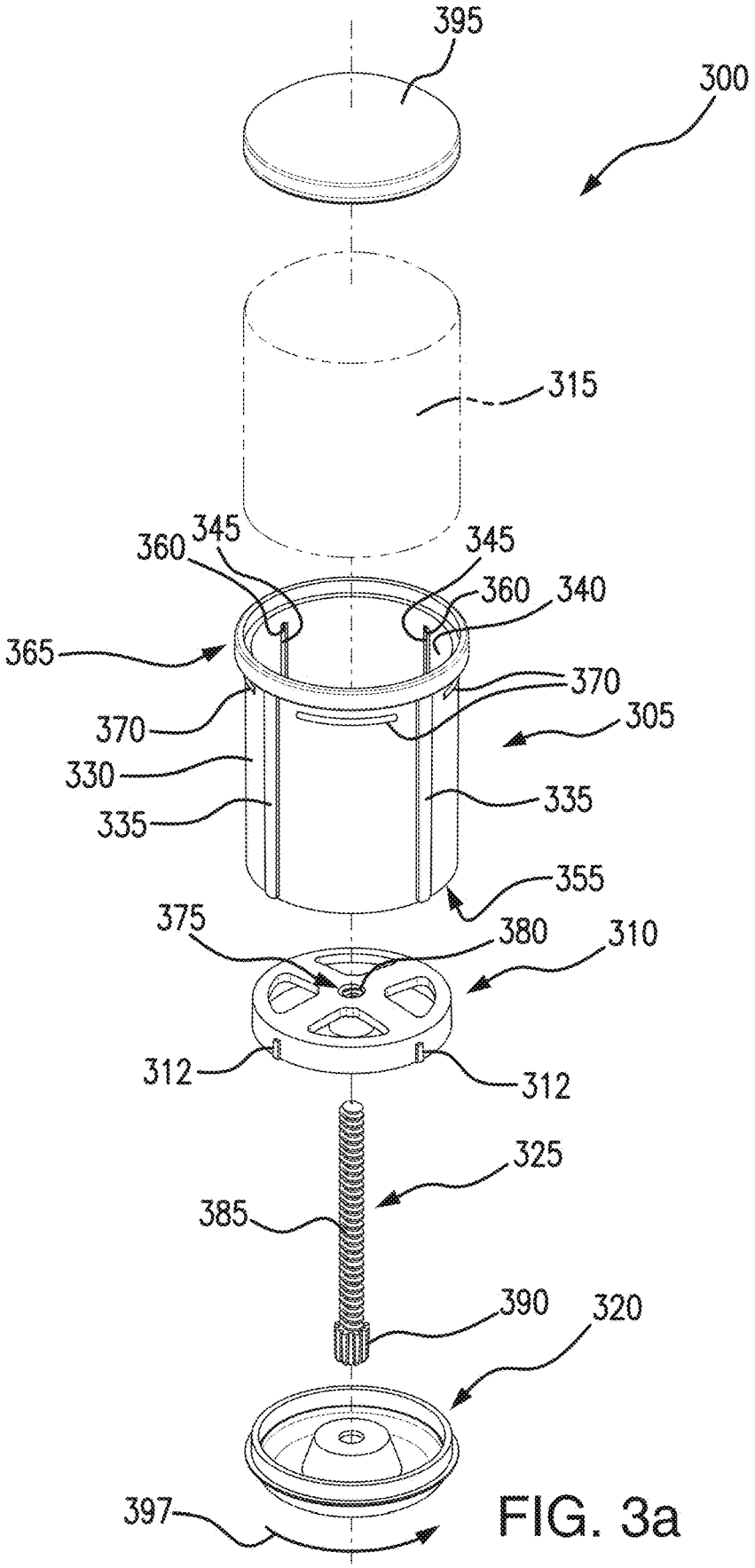
FIG. 3*a* shows an exploded view of a replaceable deodorant cartridge according to the present invention.
Figure 3B:
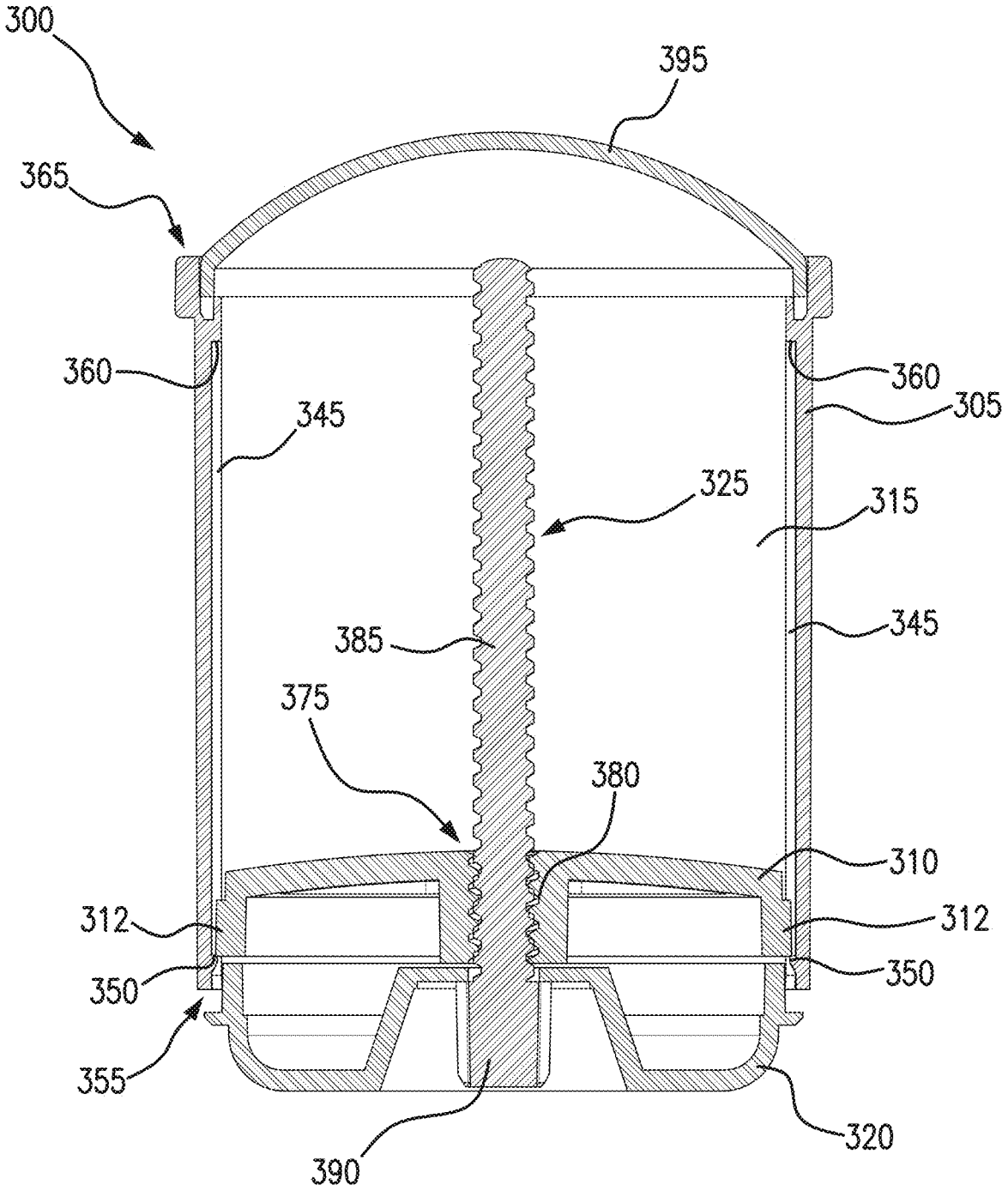
FIG. 3*b* shows a sectional view of the replaceable deodorant cartridge shown in FIG. 3*a*.

Referring now to FIGS. 3*a* and 3*b*, there is seen exploded and sectional views of an exemplary deodorant cartridge 300 in accordance with the present invention. Deodorant cartridge 300 includes a sleeve 305, a platform 310 and a deodorant puck 315 positioned within sleeve 305, a terminating bottom cap 320 coupled to distal end 355 of sleeve 305, a cylindrical spindle 325 penetrating platform 310 and bottom cap 320 and partially disposed within sleeve 305, and a removable cover 395 (may be disposable) positioned over proximal end 365 of sleeve 305 for covering and protecting deodorant puck 315 before or after use.

Outer surface 330 of sleeve 305 is provided with guiding rails 335 that mate with cartridge-receipt grooves 215 to permit deodorant cartridge 300 to be inserted within and removed from body 205 of reusable case 200. When fully and properly inserted, engagement ribs 370 snap-fit with mating grooves 245 of body 205 for removably maintaining cartridge 300 within case 200. To permit platform 310 to slide within sleeve 305 in guided fashion for dispensing deodorant puck 315, inner surface 340 of sleeve 305 is provided with guiding grooves 345 that receive tabs 312 of platform 310. Stoppers 350 are positioned adjacent to guiding grooves 345 for preventing platform 310 from sliding too far toward distal end 355 of sleeve 305, whereas terminal ends 360 of guiding grooves 345 prevent platform 310 from sliding out of proximal end 365 of sleeve 305.

Spindle 325 is provided with surface threads 385 that screwably engage bore threads 380 within a central bore 375 of platform 310. Spindle 325 is also provided with an operating end 390 structured to removably mate with spindle receipt structure 222 of dial 220 of case 200 for rotation of spindle 325 along a predetermined rotational direction 397. Rotation of spindle 325 along predetermined rotational direction 397 causes platform 310 to advance toward proximal end 365 of sleeve 305 in controllable fashion for dispensing deodorant puck 315, whereas rotation of spindle 325 along the opposite rotational direction causes platform 310 and deodorant puck 315 to retract within sleeve 305.

Figure 4:
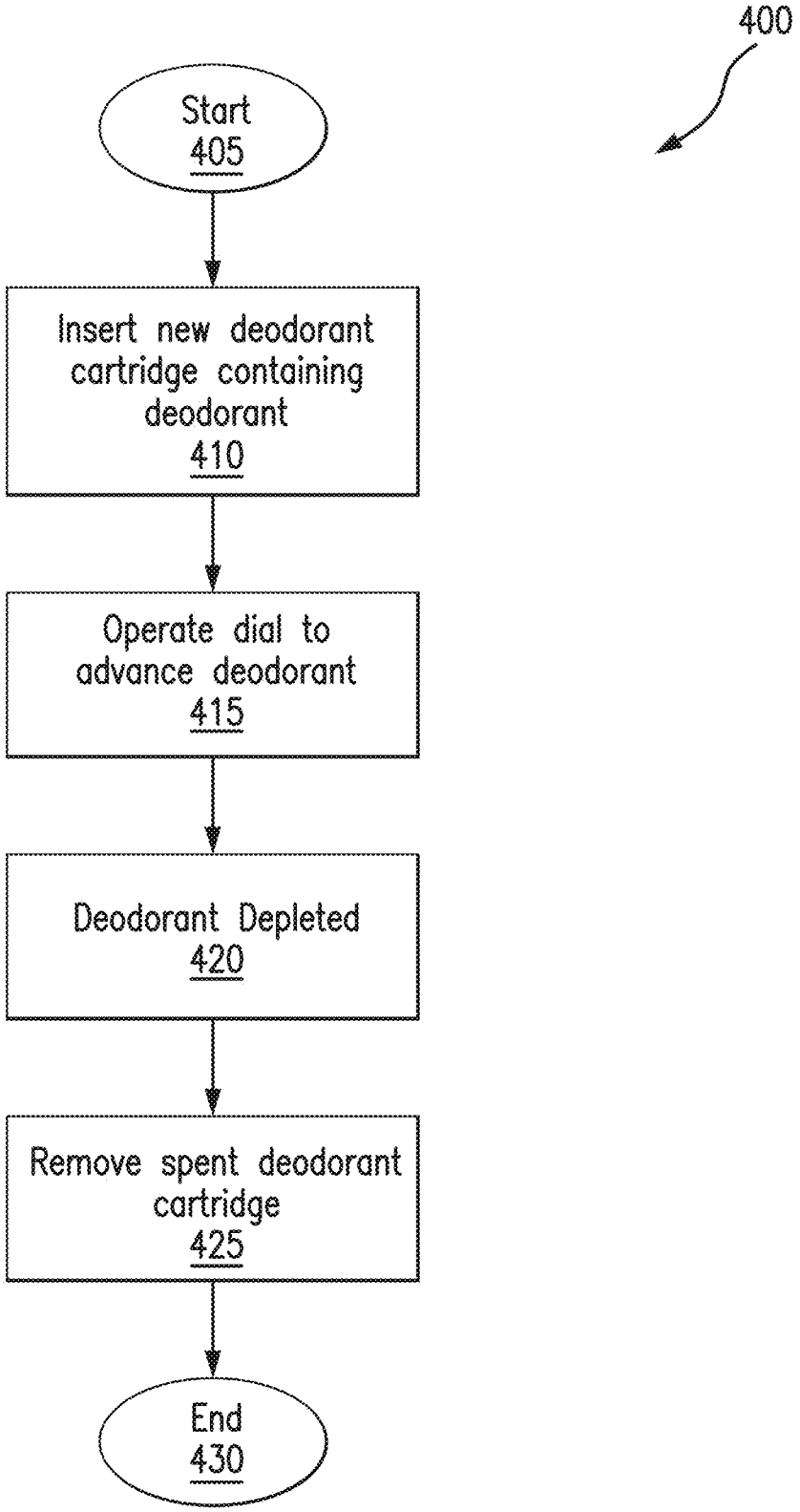
FIG. 4 shows a flowchart detailing operation of a deodorant dispensing system according to the present invention.
Figure 5A:
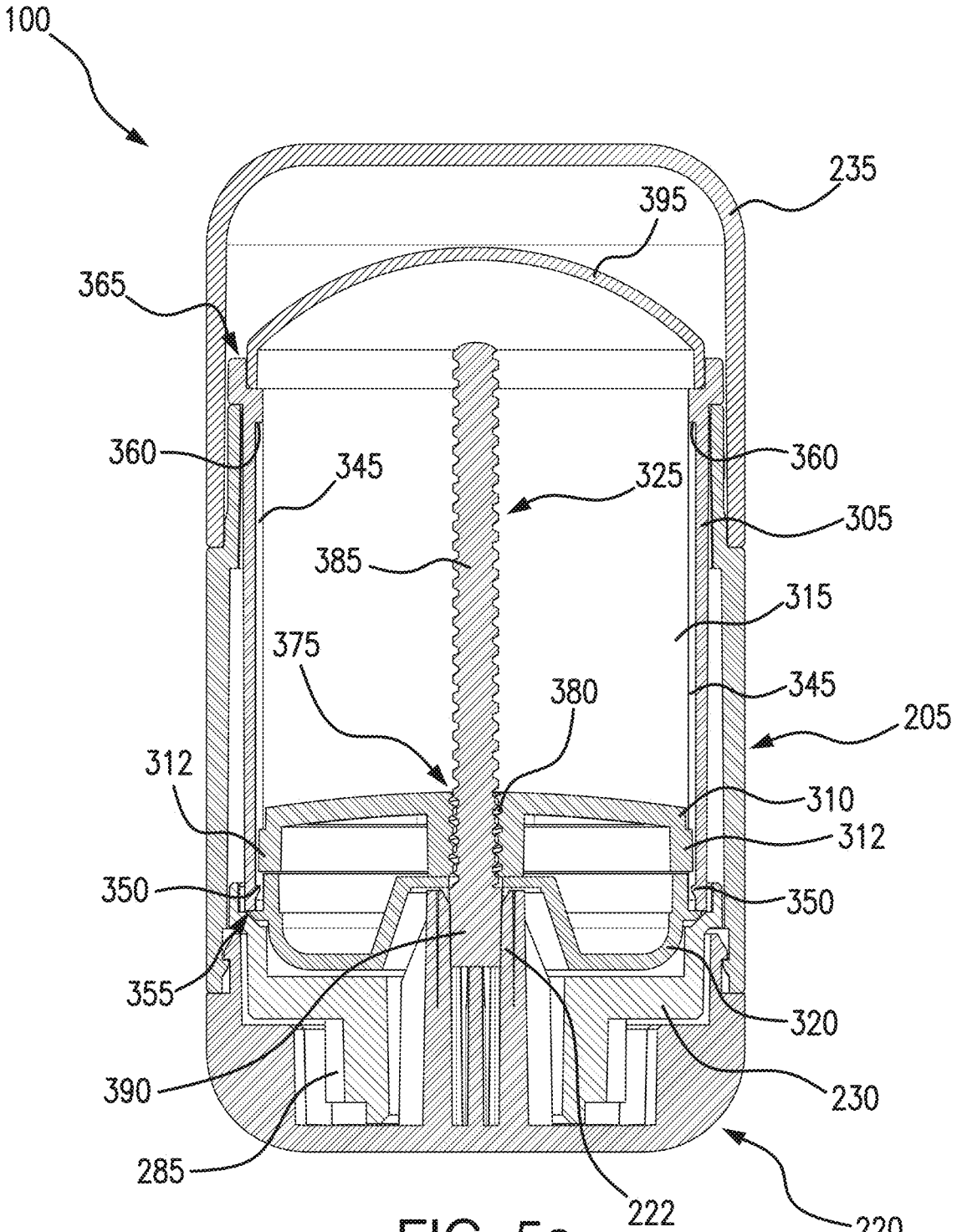
FIG. 5*a* shows a sectional view of a deodorant dispensing system according to the present invention with a newly inserted deodorant cartridge.
Figure 5B:
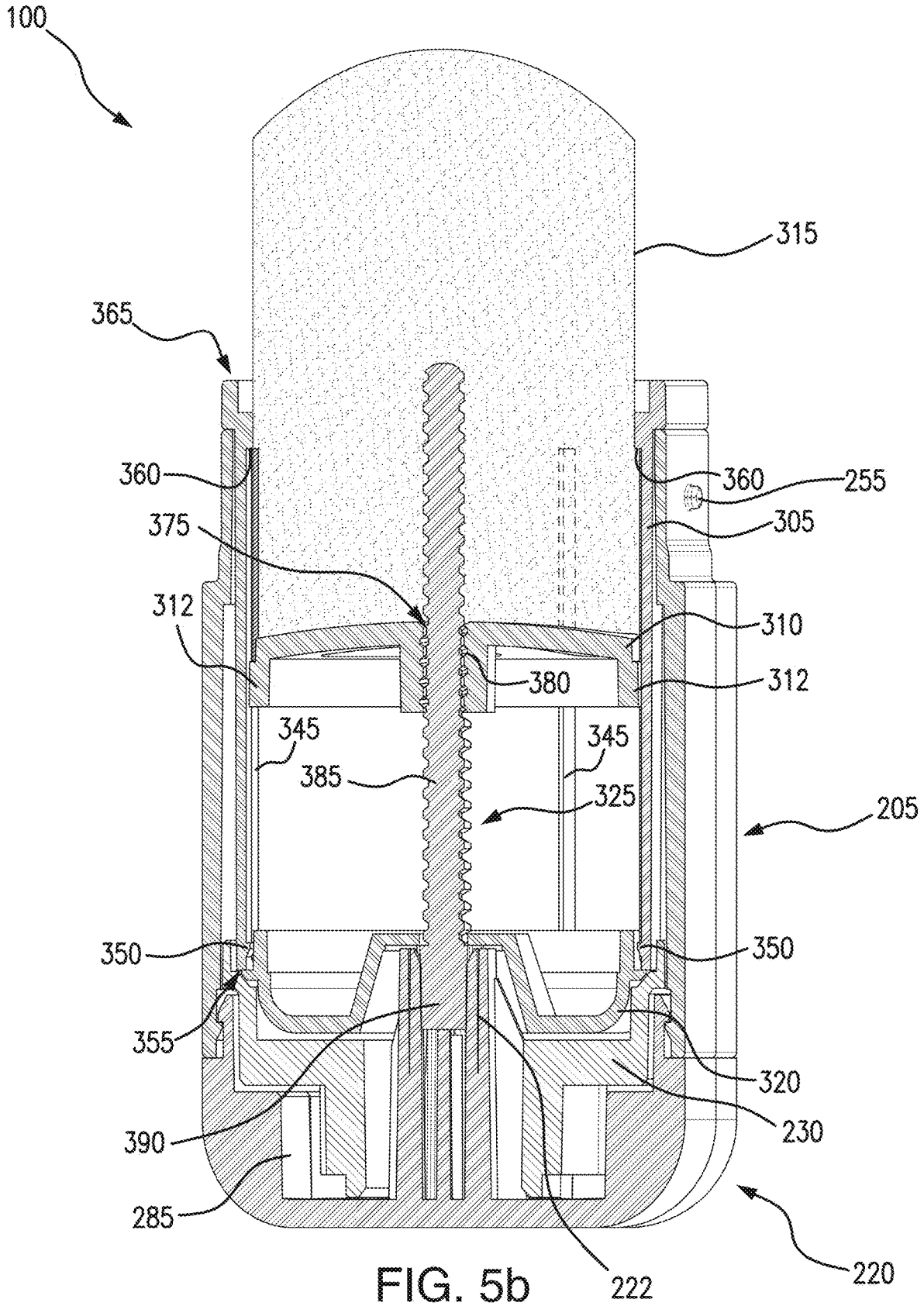
FIG. 5*b* shows the deodorant dispensing system shown in FIG. 5*a* with the unused deodorant partially dispensed.
Figure 5C:
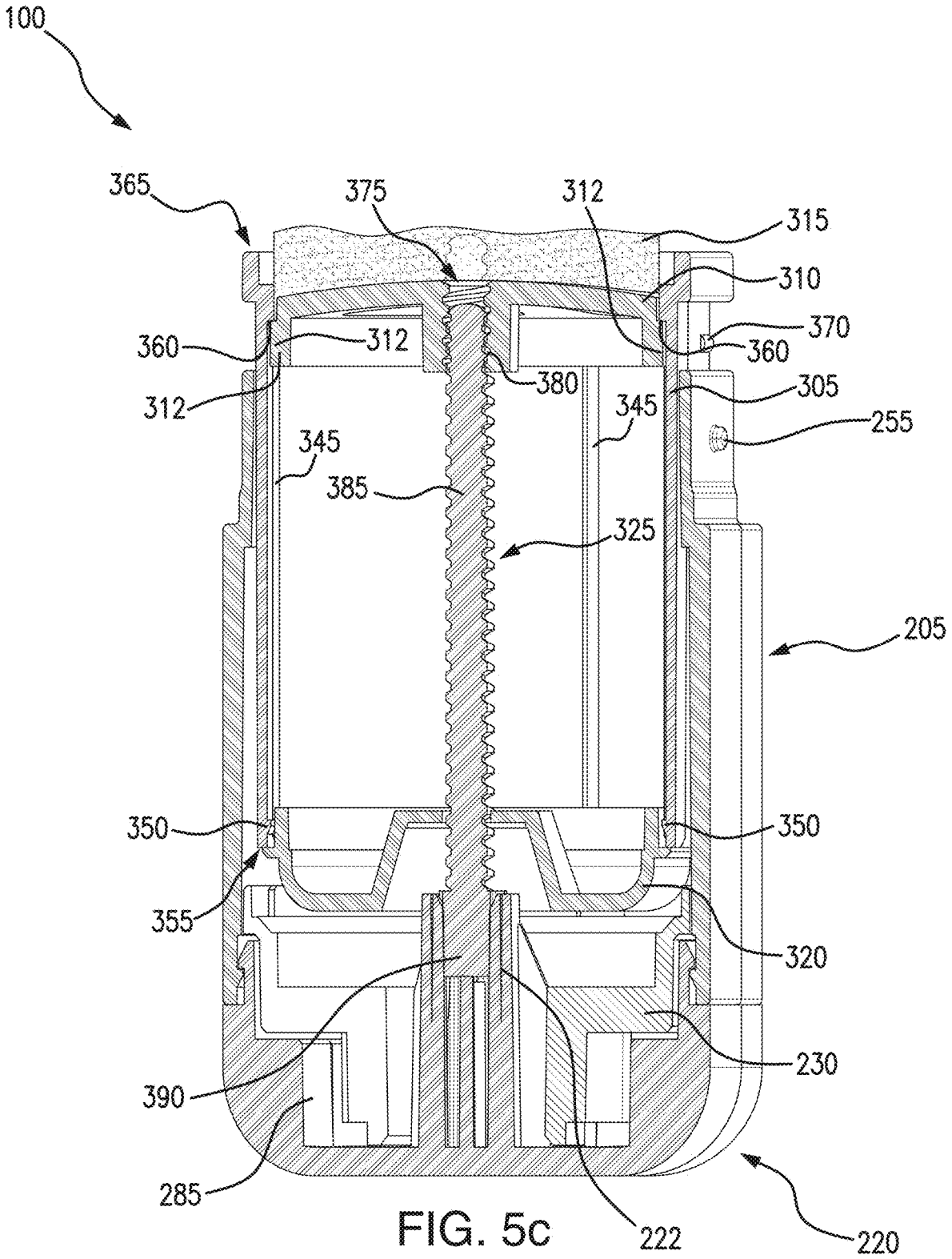
FIG. 5*c* shows the deodorant dispensing system shown in FIG. 5*a* with a partially ejected deodorant cartridge.

Referring now to FIG. 4, there is seen a process 400 detailing typical operation of deodorant dispensing system 100 by a user. Process 400 begins at step 405 and proceeds to step 410, at which the user inserts a new deodorant cartridge 300 into body 205 of case 200 until engagement ribs 370 of sleeve 305 snap-fit with mating grooves 245 of body 205 (see FIG. 5*a* showing a sectional view of deodorant dispensing system 100 with a newly inserted cartridge 300). After insertion of cartridge 300, the user removes removable cover 395, after which process 400 proceeds to step 415. At step 415, the user rotates dial 220 along predetermined rotational direction 397 to advance platform 310 toward proximal end 365 of sleeve 305 to dispense deodorant puck 315 for use (see FIG. 5*b* showing a sectional view of deodorant dispensing system 100 with a partially dispensed deodorant puck 315). As deodorant dispensing system 100 is used and operated over time, deodorant puck 315 is depleted, thereby requiring the user to periodically operate dial 220 to advance more of unused deodorant puck 315. Deodorant puck 315 may be advanced in this manner until tabs 312 of platform 310 abut terminal ends 360 of guiding grooves 345, at which time process 400 proceeds to step 420 signifying depletion of deodorant puck 315. At step 425 the user removes spent cartridge 300 from case 200. To remove cartridge 300, the user continues to rotate dial 220 along predetermined rotational direction 397 while tabs 312 of platform 310 abut terminal ends 360 of guiding grooves 345. Since terminal ends 360 prevent further advancement of platform 310 within sleeve 305, such rotation causes spindle 325 to produce a downward force on spindle receipt structure 222 of dial 220. This, in turn, produces and equal and opposite upward force on sleeve 305 against resistance created by the snap-fit between engagement ribs 370 and mating ribs 245 of body 205. Further rotation of dial 220 increases the upward force until this resistance is overcome, thereby causing cartridge 300 to partially eject from case 200 (see FIG. 5*c* showing a sectional view of deodorant dispensing system 100 with a partially ejected deodorant cartridge 300). The user may then grip proximal end 365 of sleeve 305 to remove cartridge 300 fully from case 200. In another embodiment, proximal end 240 of body 205 is provided with one or more cutouts that expose more of outer surface 330 of sleeve 305, thereby assisting the user in gripping cartridge 300 for removal thereof. The process then ends at step 430.

Figure 6:
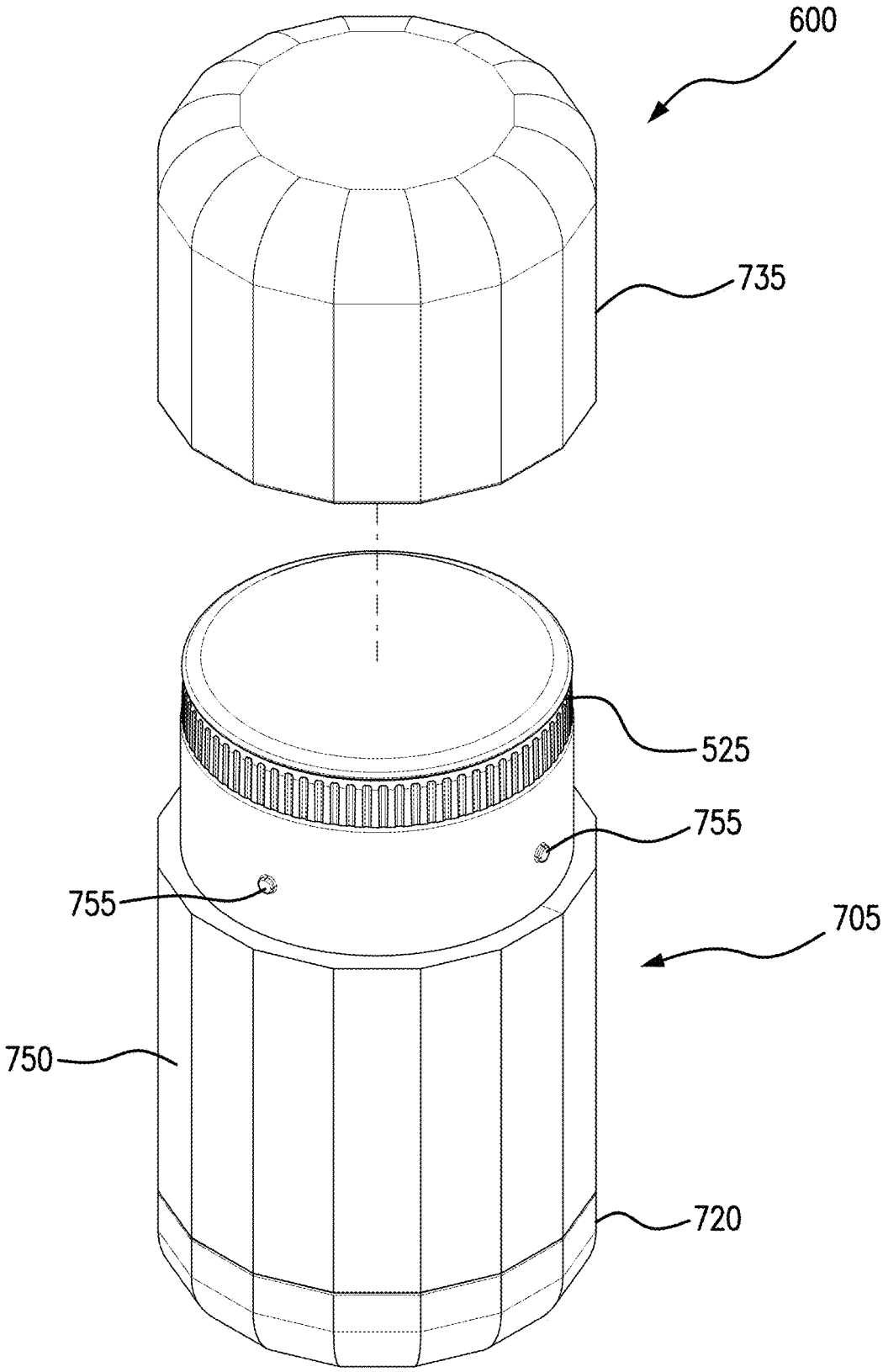
FIG. 6 shows a perspective view of a deodorant dispensing system according to the present invention with a top cap removed.

Referring now to FIG. 6, there is seen a perspective view of another exemplary deodorant dispensing system 600 according to the present invention. Dispensing system 600 includes reusable deodorant case 700 (with top cap 735) and replaceable stick deodorant cartridge 800. Deodorant dispensing system 100 is operable to dispense a deodorant puck for application by a user.

Figure 7A:
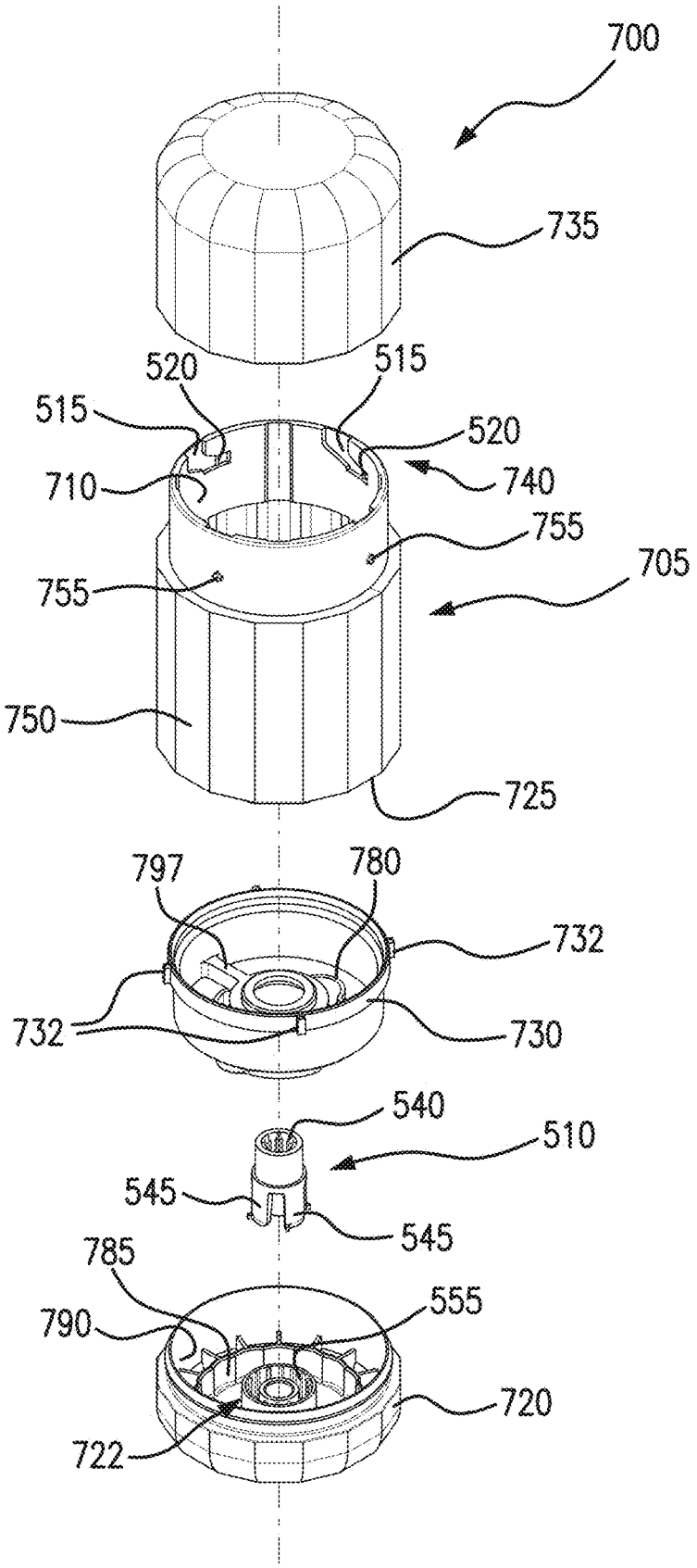
FIG. 7*a* shows an exploded view of a reusable deodorant case according to the present invention.
Figure 7B:
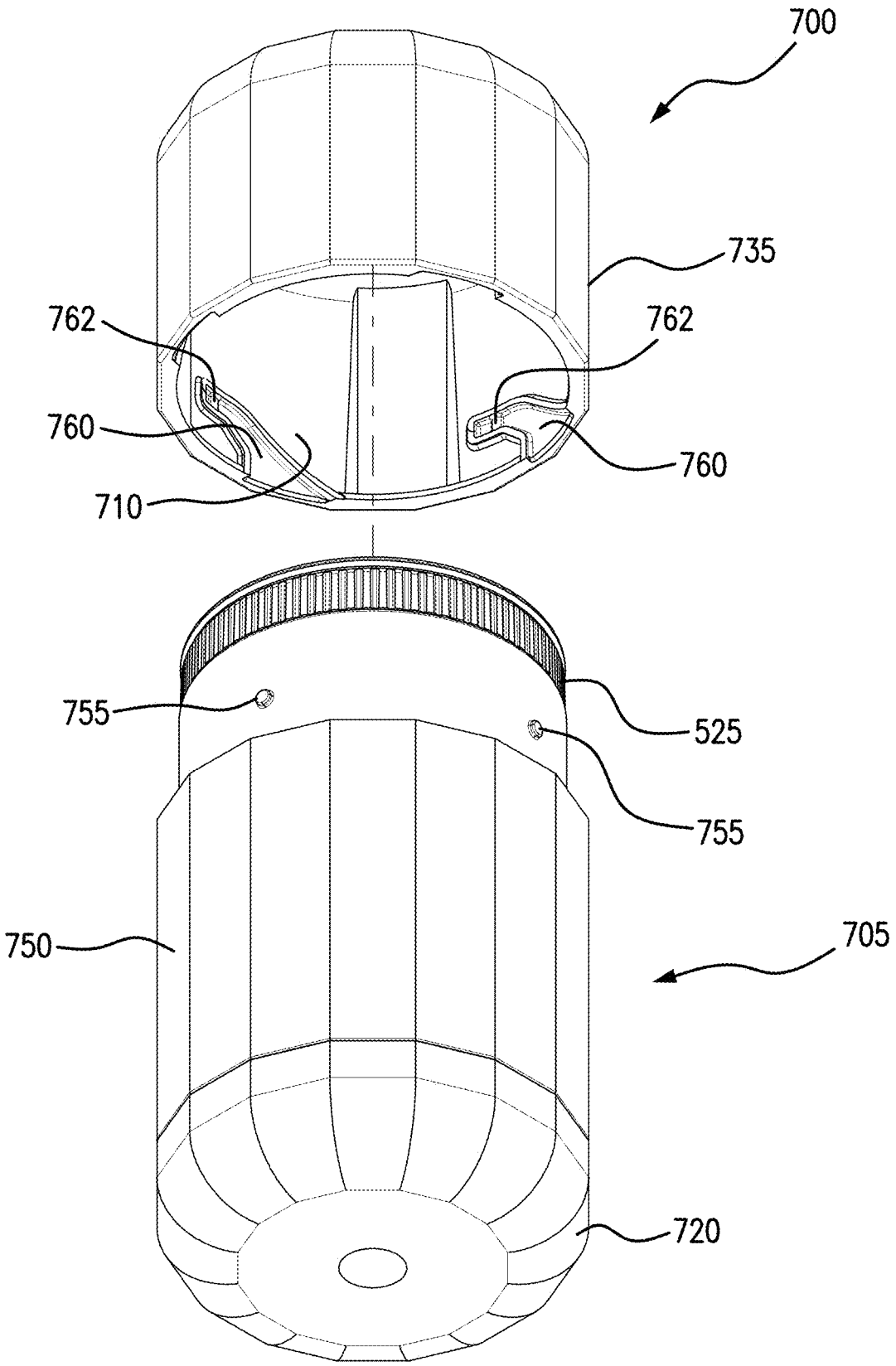
FIG. 7*b* shows a different partially exploded view of the reusable deodorant case shown in FIG. 7*a*.
Figure 7C:
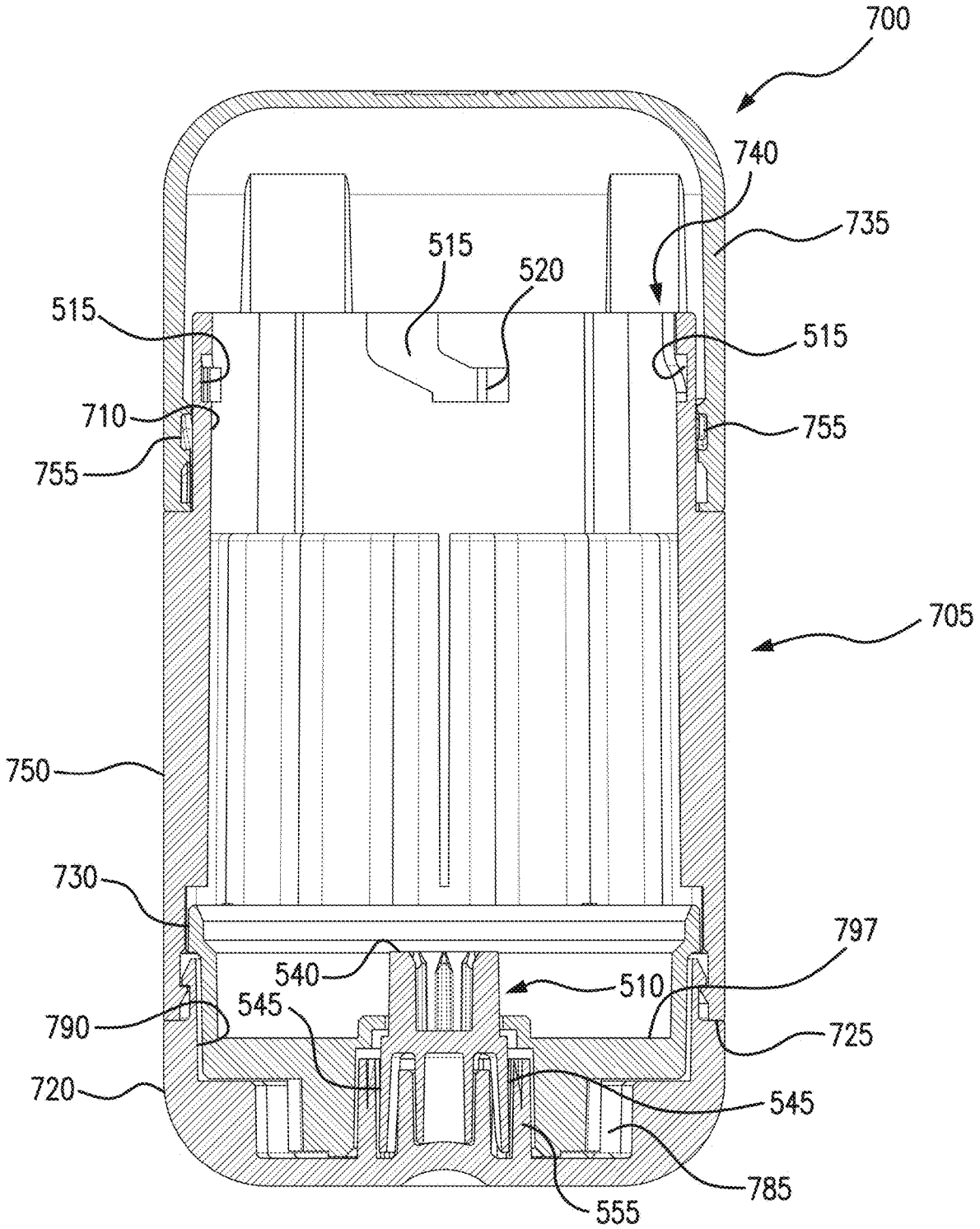
FIG. 7*c* shows a sectional view of the reusable deodorant case shown in FIG. 7*a*.

Referring now to FIGS. 7*a* though 7*c*, there is seen various views of an exemplary reusable deodorant case 700 in accordance with the present invention. Case 700 includes a body 705, a positioning member 730 positioned at distal end 725 of body 705, a dial 720 with a clutch receipt structure 722 rotatably coupled to distal end 725 and enclosing positioning member 730, a clutch 510 positioned rotatably within clutch receipt structure 722 and a removeable top cap 735 coupled to proximal end 740 of body 705.

Inner surface 710 of body 705 is provided with mating channels 515 for receiving and maintaining deodorant cartridge 800 within body 705. Outer surface 750 of body 705 is provided with protrusions 755 structured to mate with respective channels 760 provided on inside surface 765 of top cap 735. When protrusions 755 are mated with channels 760, rotation of top cap 735 along a predetermined rotational direction causes protrusions 755 to advance within channels 760 and snap-fit with stopper tabs 762 to bias top cap 735 in a closed position, whereas rotation of top cap 735 in the opposite rotational direction causes protrusions 755 to retreat from channels 760 for removal of top cap 735 from body 705. Alternate closure mechanisms to bias top cap 735 in the closed position, such as threads, tabs, grooves, and combinations thereof, may also be used, all which are included within the scope of the present invention. Body 705 and/or top cap 735 may also be provided with a sealing feature, such as a ring of rubber or other suitable structure and/or material (not shown), for forming a seal between body 705 and top cap 735 when top cap 735 is rotated into the closing position. In another embodiment, outer surface 750 of body 705 is provided with one or more features to improve grip, such as texturing, rubbering, etc. (not shown).

Figure 7D:
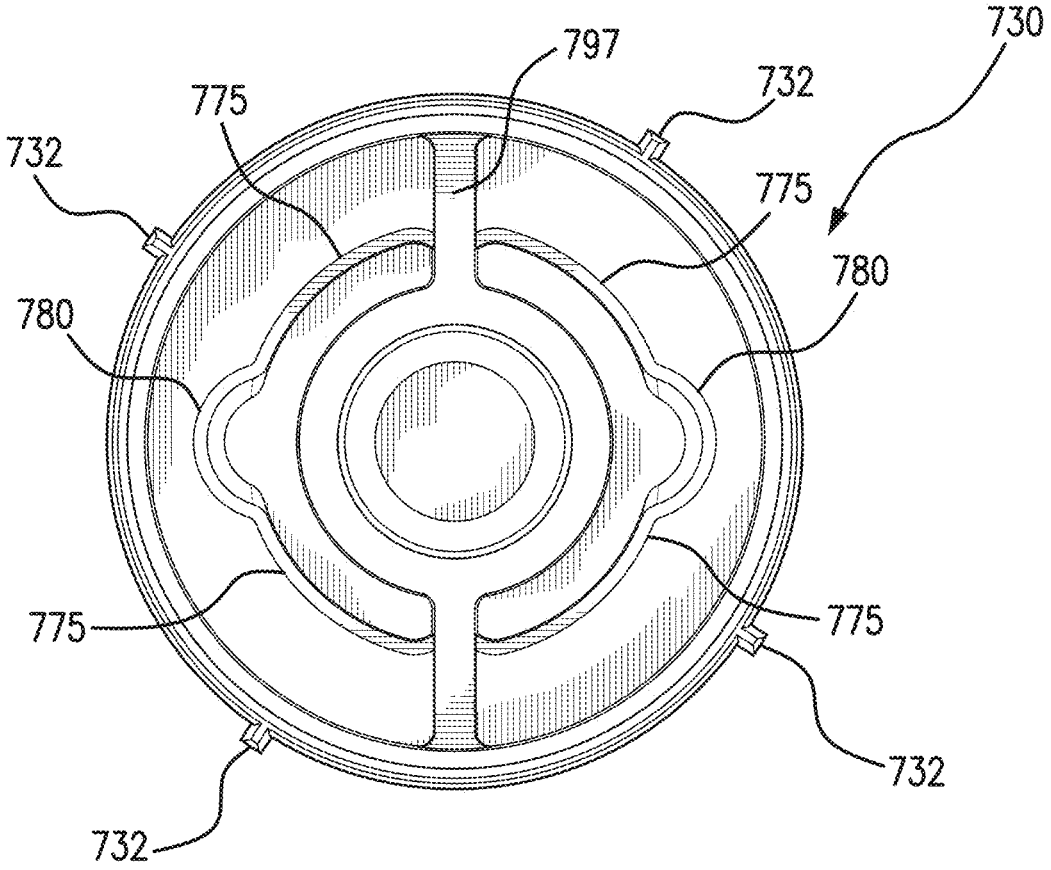
FIG. 7*d* shows a top view of a positioning member according to the present invention.
Figure 7E:
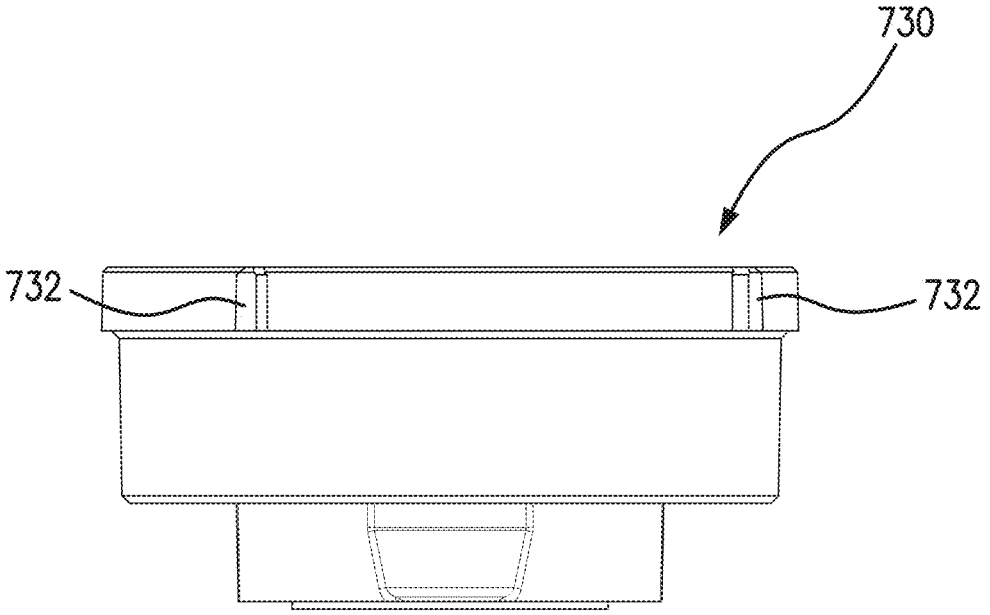
FIG. 7*e* shows a side view of the positioning member shown in FIG. 7*d*.

Referring now to FIGS. 7*d* and 7*e*, there is seen top and side views of positioning member 730. Positioning member 730 is fixedly coupled to distal end 725 of body 705. Guiding tabs 732 mate with respective receipt grooves (not shown) on inner surface 710 of body 705 to provide proper orientation of positioning member 730. Positioning member 730 includes a leaf-spring 775 fixed to a support structure 797 and a detent 780 positioned at the end of leaf-spring 775. Leaf-spring 775 biases detent 780 into one of receptacles 785 positioned around inner surface 790 of dial. Upon rotation of dial 720 with respect to body 705, the receptacle 785 receiving detent 780 compresses leaf-spring 775, thereby displacing detent 780 toward the center of support structure 797 and advancing an adjacent receptacle 785 to detent 780. In this manner, positioning member 730 operates to permit dial 720 to be rotated into multiple discrete rotational positions. Similar to the embodiment described above with respect to FIGS. 1 through 3*b*, leaf-spring 775 and/or detent 780 may be structured to interact for making a "clicking" sound when dial 720 is rotated.

Figure 8A:
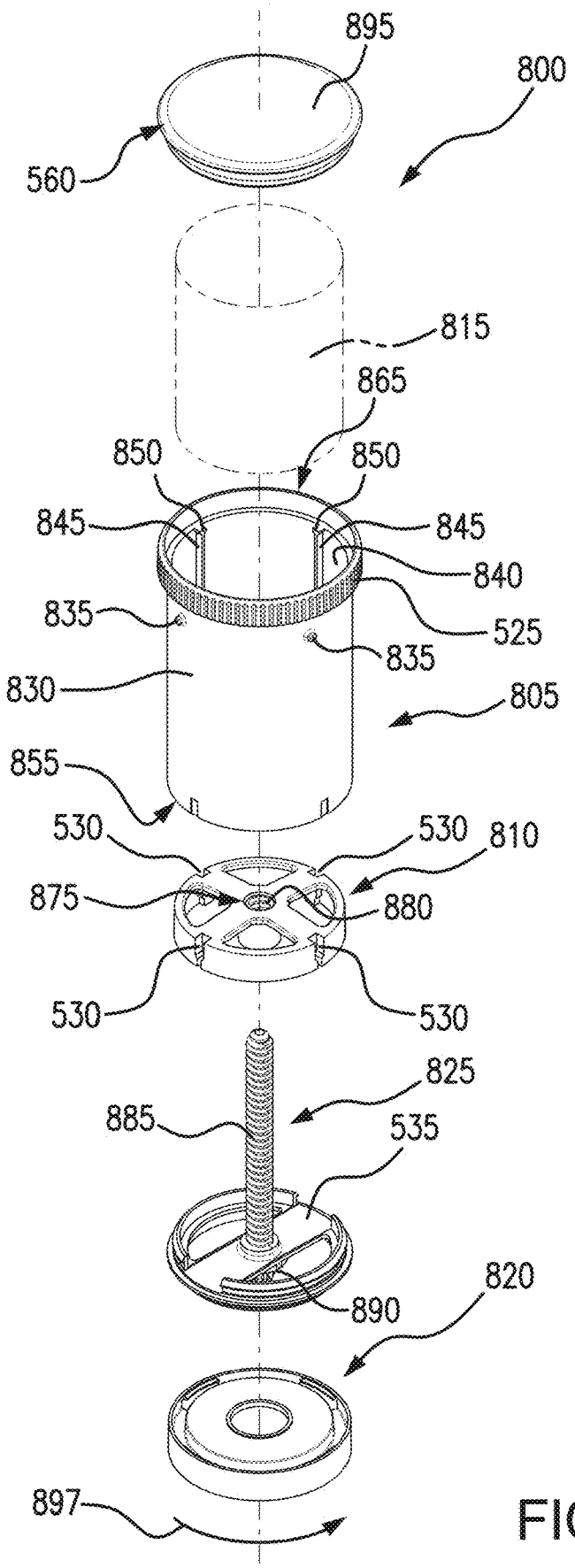
FIG. 8*a* shows an exploded view of a replaceable deodorant cartridge according to the present invention.
Figure 8B:
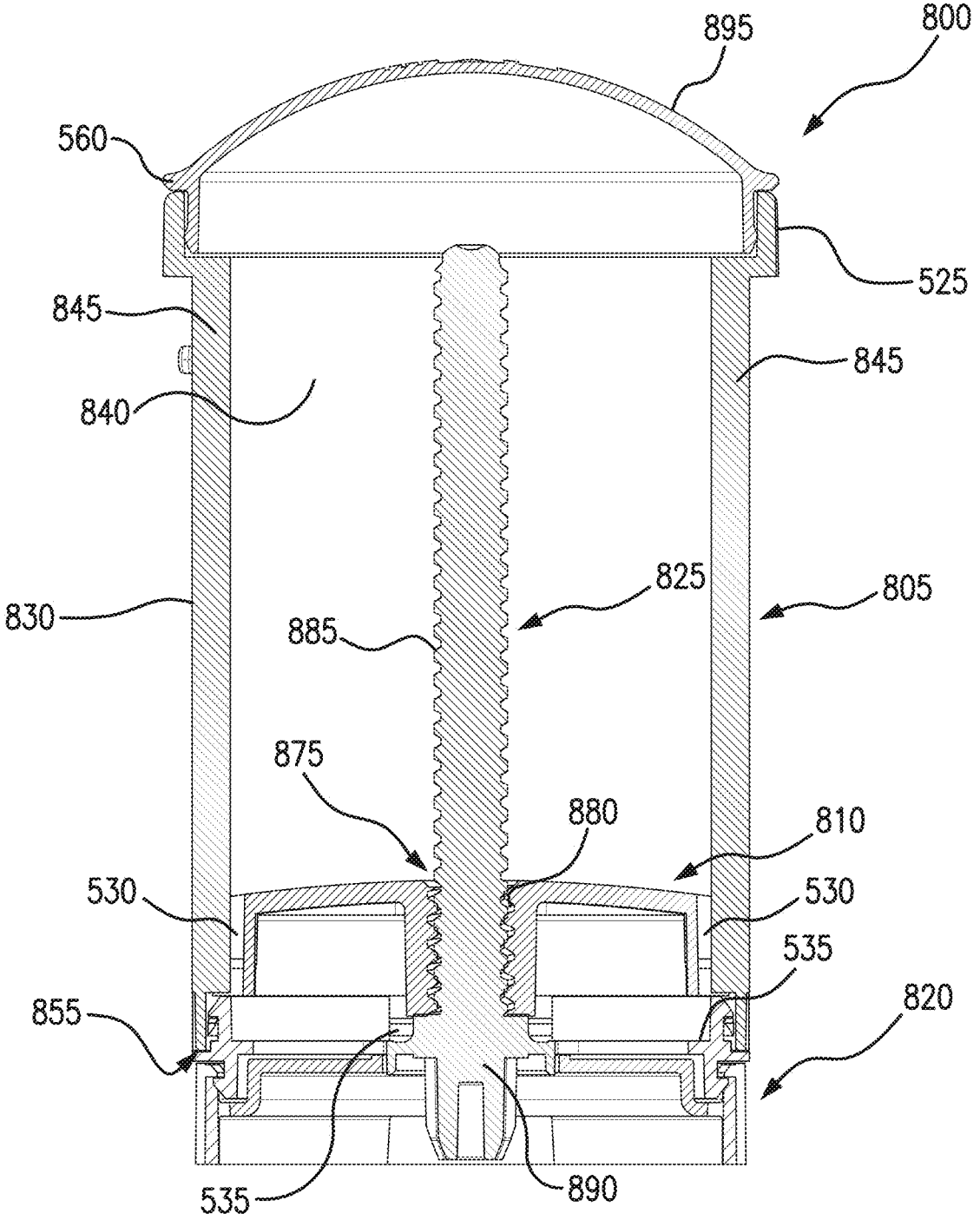
FIG. 8*b* shows a sectional view of the replaceable deodorant cartridge shown in FIG. 8*a*.
Figure 8C:
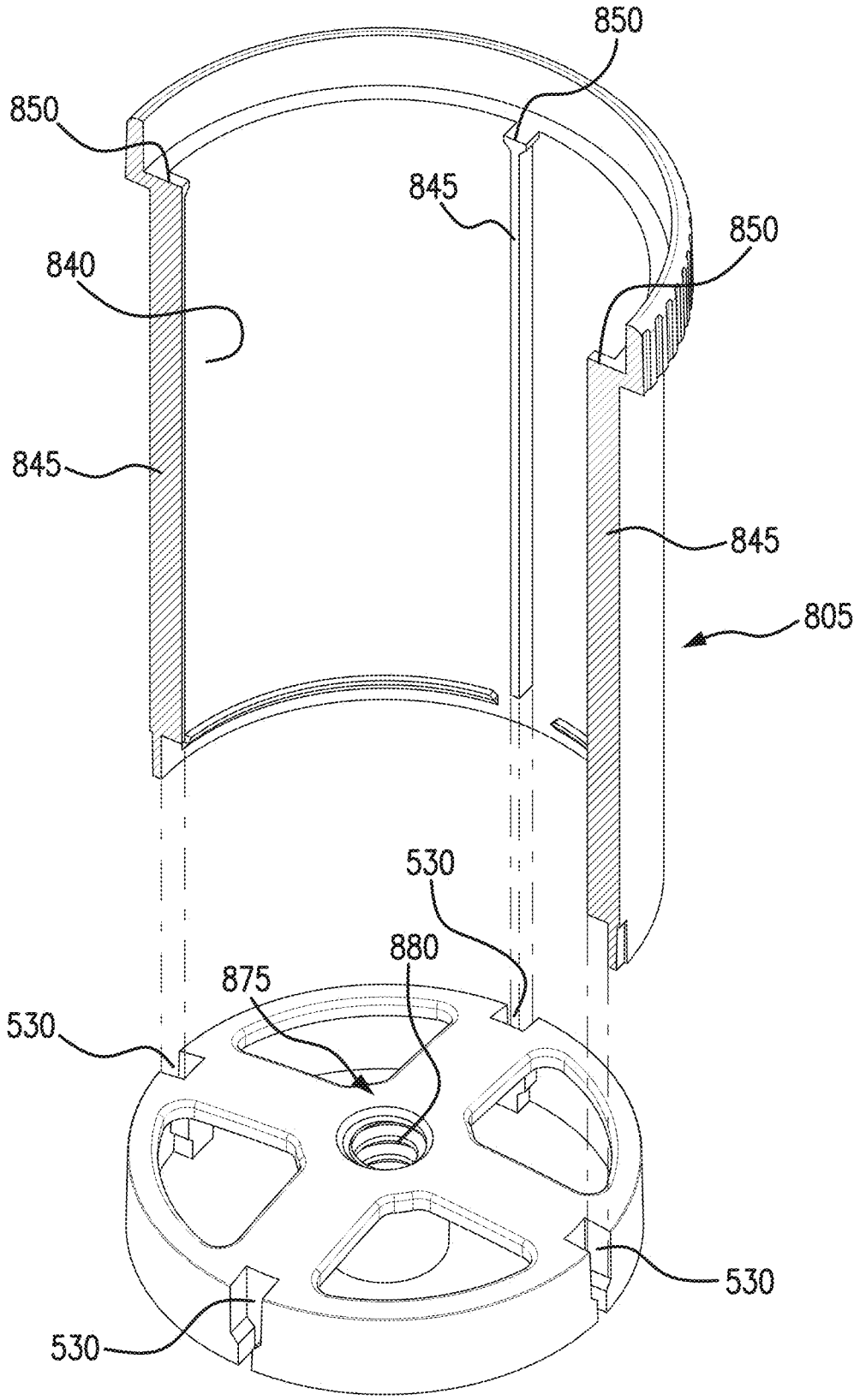
FIG. 8*c* shows a cut-away perspective view of a sleeve and platform of a deodorant cartridge according to the present invention.

Referring now to FIGS. 8*a* through 8*c*, there is seen exploded and sectional views of an exemplary deodorant cartridge 800 for use with reusable deodorant case 700. Deodorant cartridge 800 includes a sleeve 805, a platform 810 and a deodorant puck 815 positioned within sleeve 805, a terminating bottom cap 820 coupled to distal end 855 of sleeve 805, a spindle 825 penetrating platform 810 and disposed partially within sleeve 805, and a removable cover 895 (may be disposable) positioned over proximal end 865 of sleeve 805 for covering and protecting deodorant puck 815 before or after use. Removable cover 895 is provided with a lip 560 for easy gripping by a user.

Outer surface 830 of sleeve 805 is provided with a circumferential griping rail 525 and guiding tabs 835 that mate with respective mating channels 515 to permit deodorant cartridge 800 to be inserted within and removed from body 705 of reusable case 700 in a manner similar to how top cap 735 is mated with body 705. More specifically, when guiding tabs 835 are mated with mating channels 515 of body 705, rotation of cartridge 800 along a predetermined rotational direction causes guiding tabs 835 to advance within mating channels 515 and snap-fit with stopper tabs 520 to bias cartridge 800 in a closed (inserted) position, whereas rotation of cartridge 800 in the opposite rotational direction causes guiding tabs 835 to retreat from mating channels 515 for removal of cartridge 800 from body 705. Circumferential griping rail 525 facilitates insertion and removal of cartridge 800 by providing an accessible surface to be grasped easily by a user. It should be appreciated that alternate closure mechanisms for cartridge 800 may be used, such as, for example, threads, tabs, grooves, and combinations thereof.

To permit platform 810 to slide within sleeve 805 in guided fashion for dispensing deodorant puck 815, inner surface 840 of sleeve 805 is provided with guiding rails 845 for mating with respective guiding grooves 530 of platform 810. Guiding rails 845 are provided with widened stoppers 850 for preventing platform 810 from sliding too far toward (or out of) proximal end 865 of sleeve 805.

Spindle 825 is provided with surface threads 885 that screwably engage bore threads 880 within a central bore 875 of platform 810. Spindle 825 is also provided with an operating end 890 structured to removably mate with dial 720 of case 700 (via clutch 510) for rotation of spindle 825, in a manner more fully described below. A guide disc 535 formed integrally with operating end 890 snap fits into distal end 855 of cartridge 800 in rotational fashion to maintain spindle 825 in proper orientation and to prevent it from moving longitudinally with respect to sleeve 805. In operation, rotation of spindle 825 along predetermined rotational direction 897 (via dial 720 of case 700) causes platform 810 to advance toward proximal end 865 of sleeve 805 in controllable fashion for dispensing deodorant puck 815, whereas rotation of spindle 825 along the opposite rotational direction causes platform 810 and deodorant puck 815 to retract within sleeve 805.

Figure 7F:
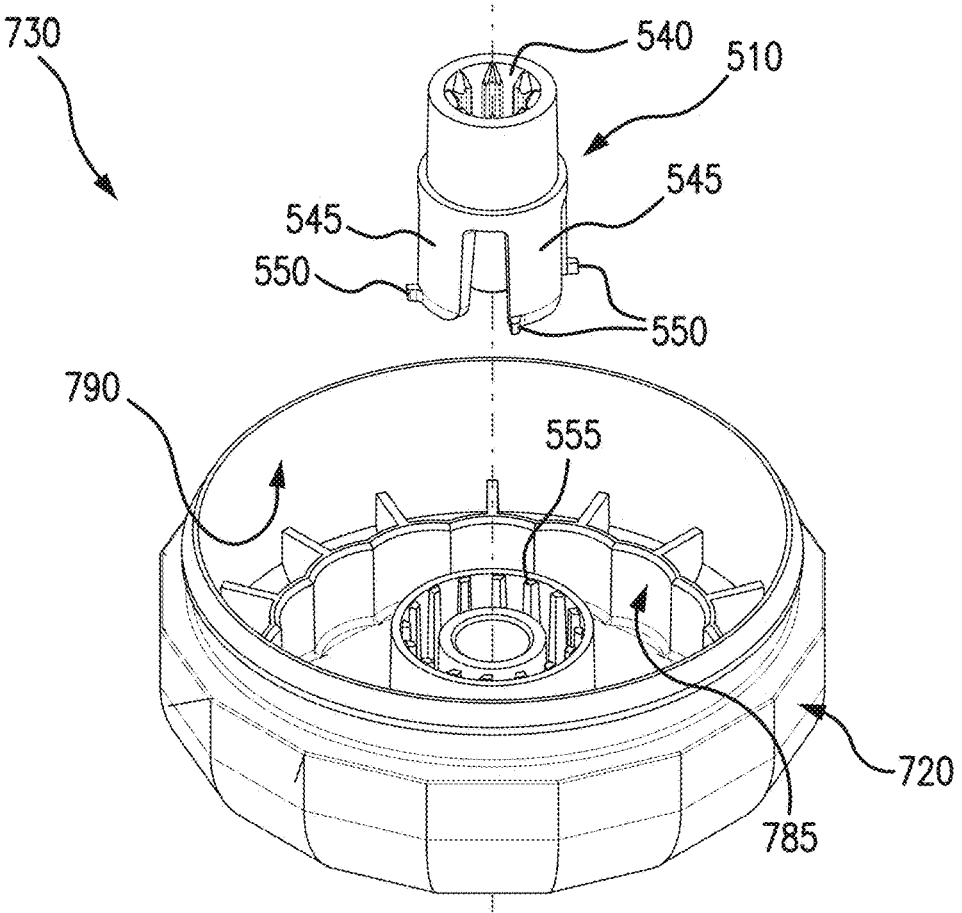
FIG. 7*f* shows an exploded perspective view of a case dial and clutch according to the present invention.
Figure 7G:
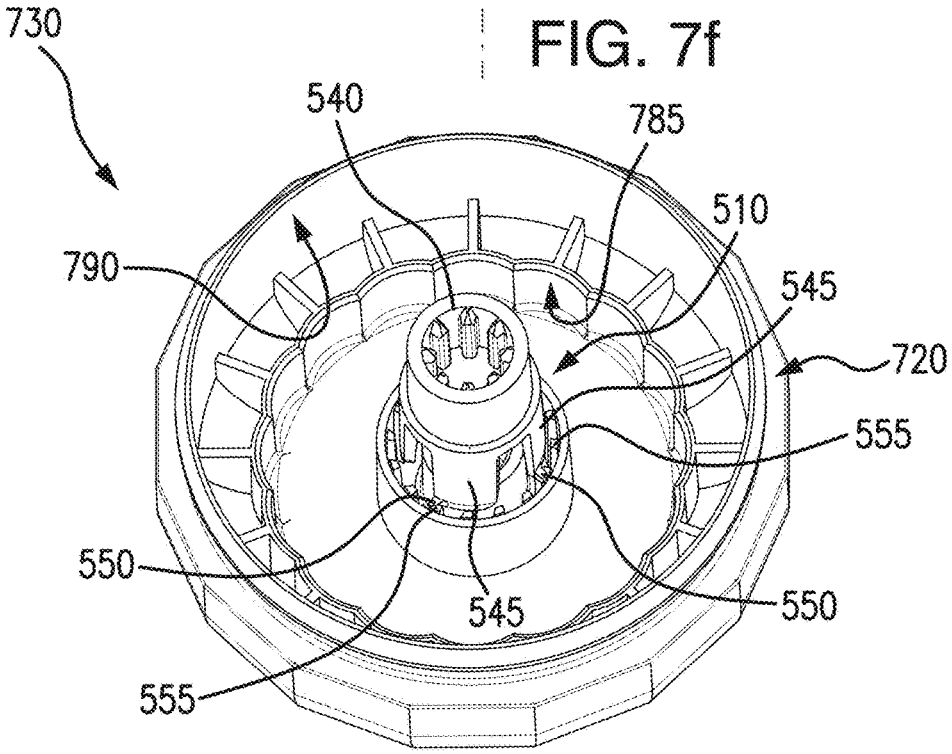
FIG. 7*g* shows a perspective view of the case dial and clutch shown in FIG. 7*f*.

As shown in FIGS. 7*f* and 7*g*, clutch 510 is disposed between spindle 825 and clutch receipt structure 722 of dial 720. Clutch 510 includes a spindle receipt receptacle 540 for receiving operating end 890 of spindle 825, biasing leafs 545, and clutch tabs 550 for engaging dial ribs 555 of clutch receipt structure 722. In operation, rotation of dial 720 along either rotational direction causes dial ribs 555 to engage clutch tabs 550 which, in turn, causes rotation of clutch 510 and spindle 825 for advancement or retraction of deodorant puck 815 in normal fashion. To the extent a user rotates dial 720 to fully retract platform 810 and deodorant puck 815 within cartridge 800, such that the bottom of platform 810 engages operating disk 535 of spindle 825, further rotation of spindle 825 (and clutch 510) along the same rotational direction is prevented. Continued rotation of dial 720 along the same rotational direction causes dial ribs 555 to engage ramped portions 552 of clutch tabs 550 with increasing force, thereby urging biasing leafs 545 inwardly toward the center of clutch 510 until clutch tabs 550 clear the engaging dial ribs 555. This, in turn, causes free rotation of dial 720 for a short distance until biasing leafs 545 bias clutch tabs 550 back into original position between adjacent pairs of dial ribs 555 (which may produce an audible snap or clicking sound). Continued rotation of dial 720 along the same direction produces a similar result and allows dial 720 to rotate freely without a commensurate rotation of spindle 825. In this manner, clutch 510 prevents an excessive and potentially damaging torque from being applied to spindle 825 by over rotation of dial 720. It should be appreciated that clutch 510 may be designed to also prevent over extension of platform 810, such as, for example, by providing clutch tabs 550 with ramped portions on both sides. It should also be appreciated that the materials used to design clutch 510 (with biasing leafs 545) and the thickness or other design parameters of biasing leafs 545 may be selected to allow for a desired amount of torque to be reached before allowing free rotation of dial 720.

The various different elements of deodorant dispensing systems 100 and 600 described above may be constructed as unitary pieces or from multiple pieces, and may be manufactured (such as via casting or 3D printing) or handcrafted from any material(s) of sufficient strength and stiffness to enable the elements of dispensing systems 100 and 600 to operate as described herein, such as metal (e.g., titanium, precious metals), silicone, plastic, resin, composites, non-corrosive materials, hypoallergenic materials, etc. Dispensing systems 100 and 600 may also be customized to exhibit personalized aesthetic features selected by a user, such as, for example, by imprinting user-selected graphics on the outside of cases 200 and/or 700.

Figure 9:
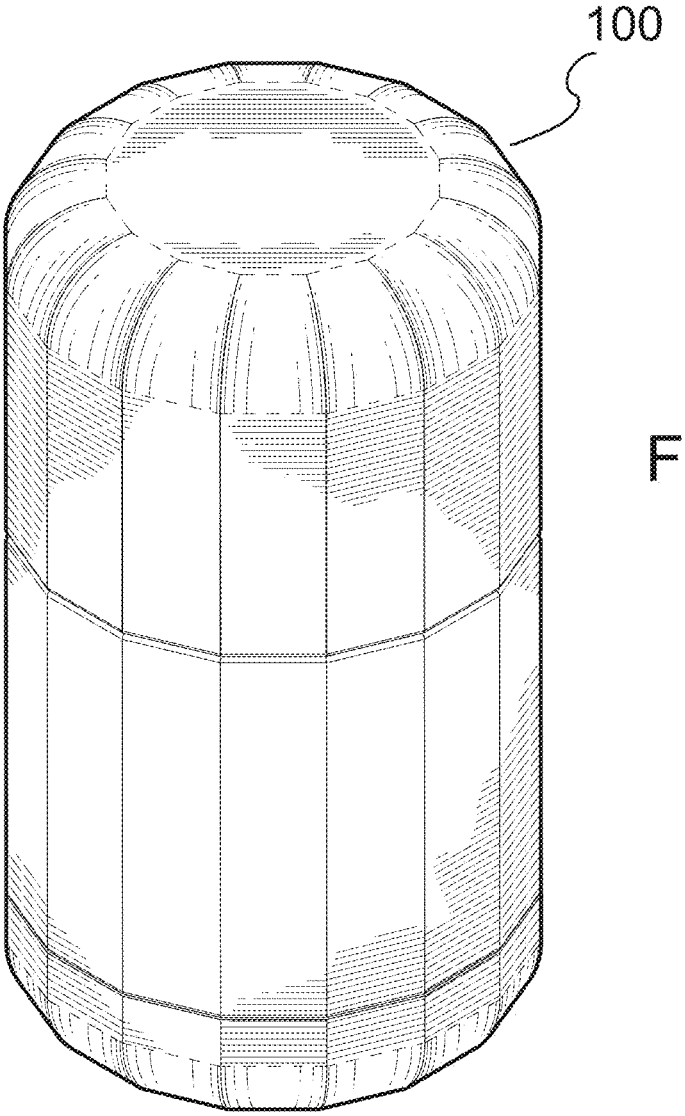
FIG. 9 shows a front perspective view of the outside of a reusable deodorant case according to the present invention.
Figure 10:
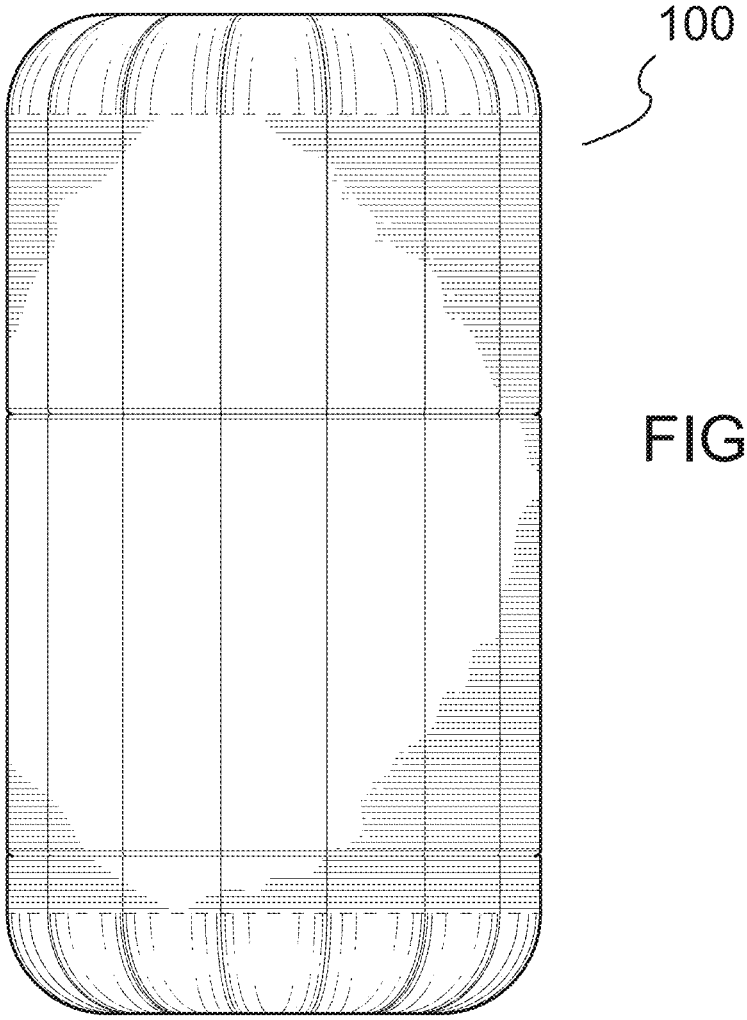
FIG. 10 shows a front side view of the outside of a reusable deodorant case according to the present invention, the back side view being a mirror image thereof.
Figure 11:
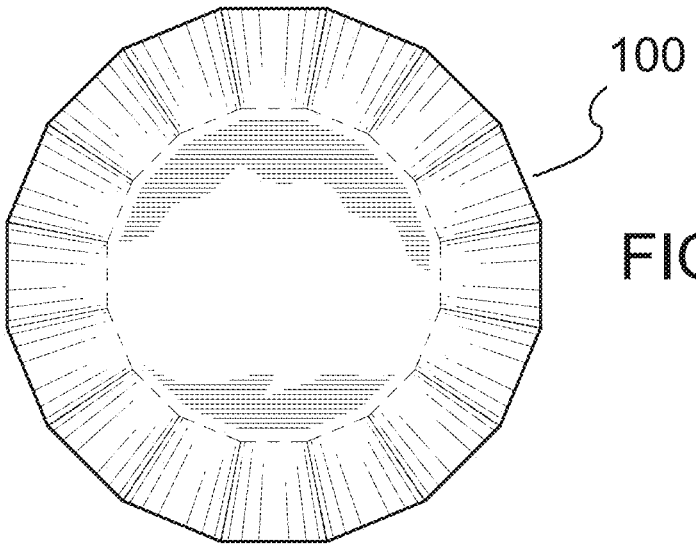
FIG. 11 shows a top view of the outside of a reusable deodorant case according to the present invention.
Figure 12:
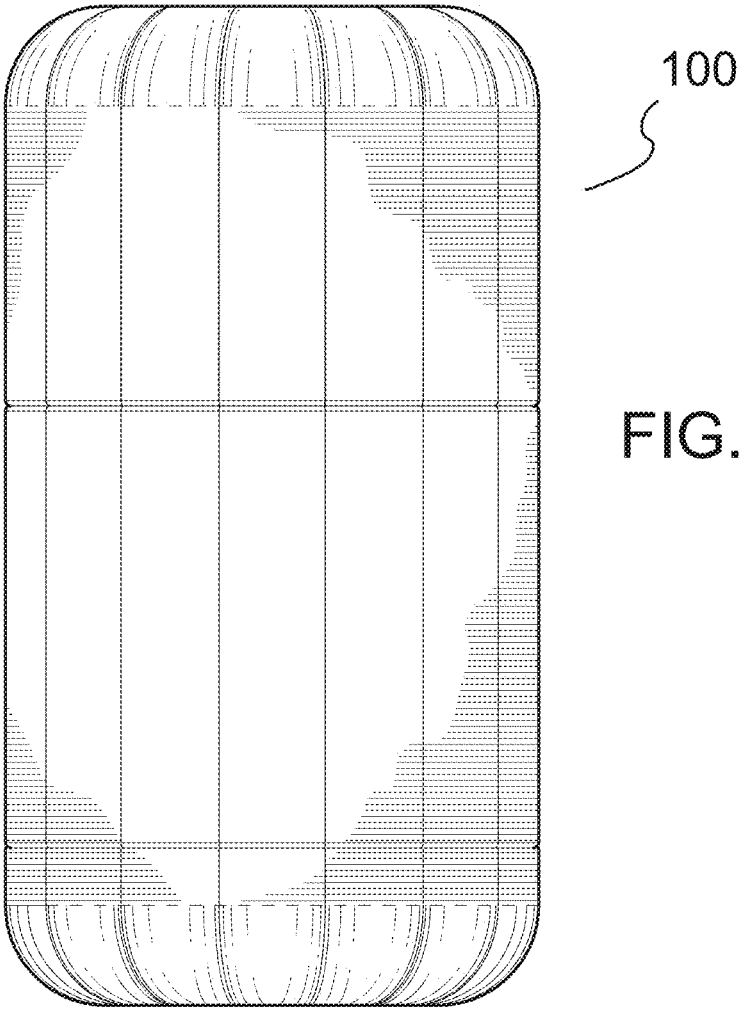
FIG. 12 shows a right side view of the outside of a reusable deodorant case according to the present invention, the left side view being a mirror image thereof.
Figure 13:
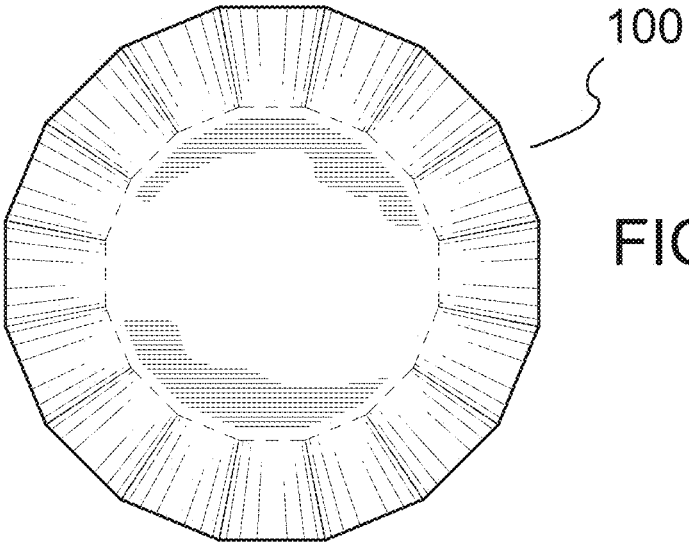
FIG. 13 shows a bottom view of the outside of a reusable deodorant case according to the present invention.

Referring now to FIGS. 9 though 13, there is seen the outside appearance of the reusable deodorant case according to the present invention. FIG. 9 shows a front perspective view of the outside of a reusable deodorant case. FIG. 10 shows a front side view of the outside of a reusable deodorant case, the back side view being a mirror image thereof. FIG. 11 shows a top view of the outside of a reusable deodorant case. FIG. 12 shows a right side view of the outside of a reusable deodorant case, the left side view being a mirror image thereof. FIG. 13 shows a bottom view of the outside of a reusable deodorant case.

Figure 14:
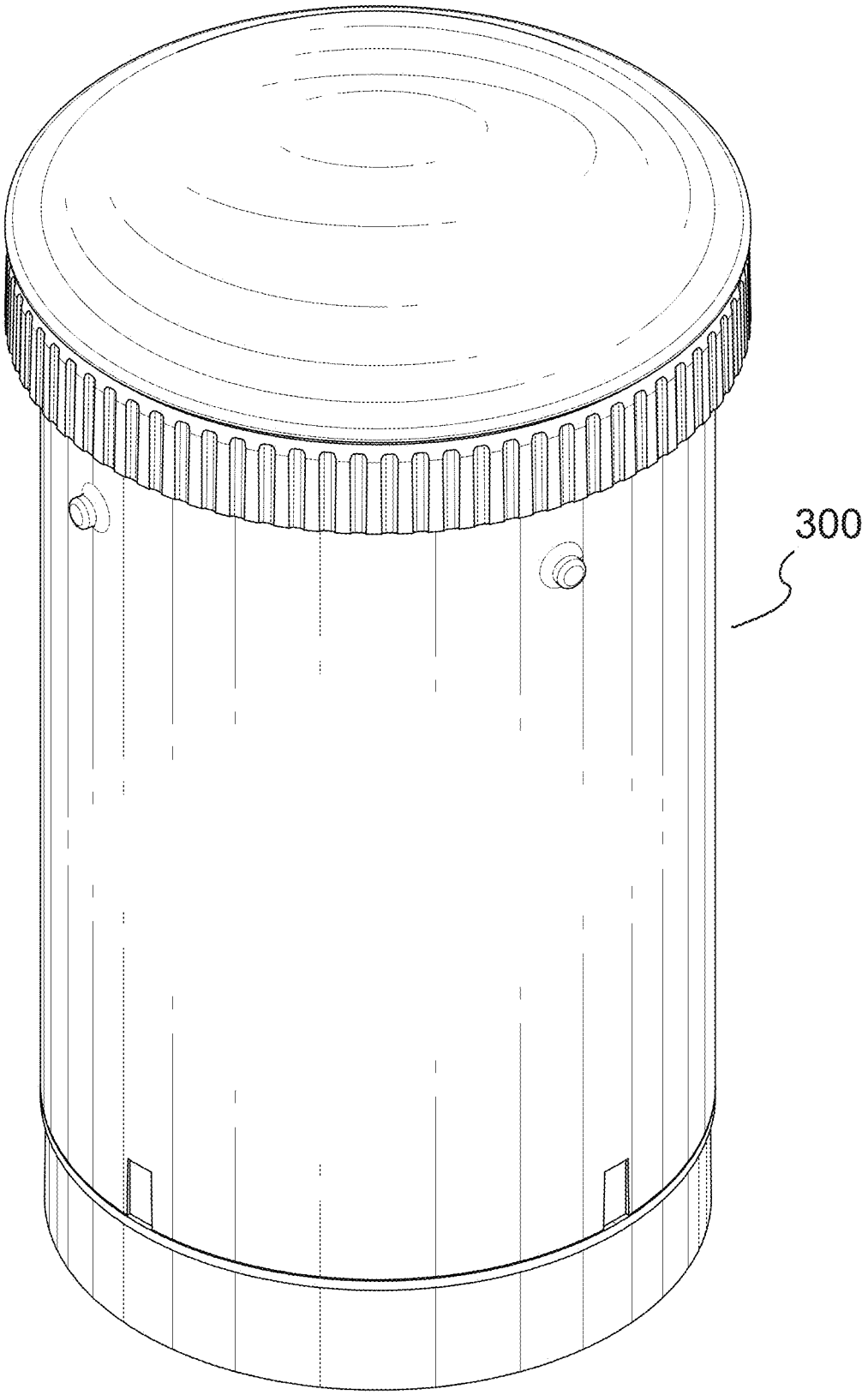
FIG. 14 shows a front perspective view of a replaceable deodorant cartridge according to the present invention.
Figure 15:
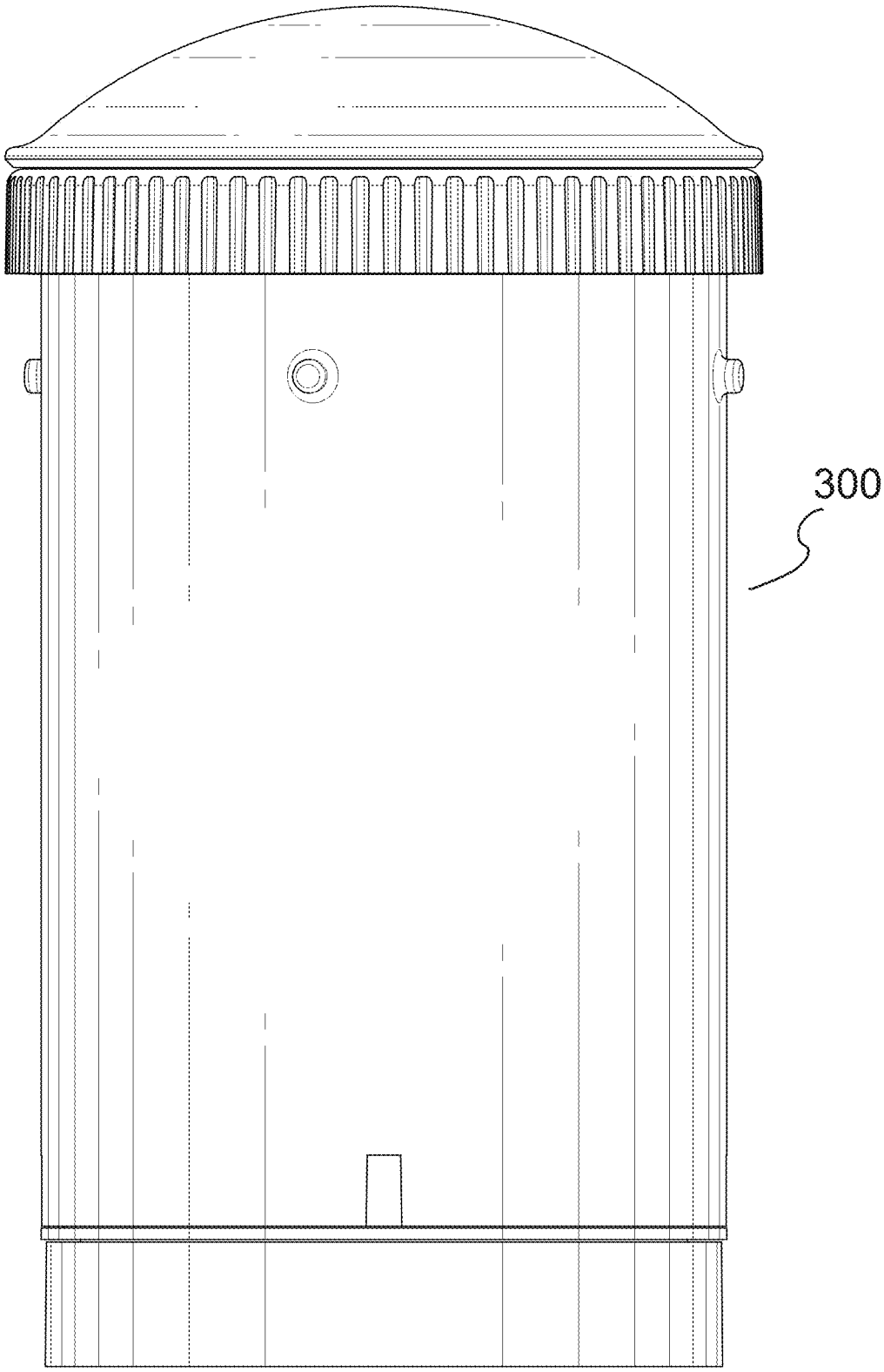
FIG. 15 shows a front view of a replaceable deodorant cartridge according to the present invention, the back view being a mirror image thereof.
Figure 16:
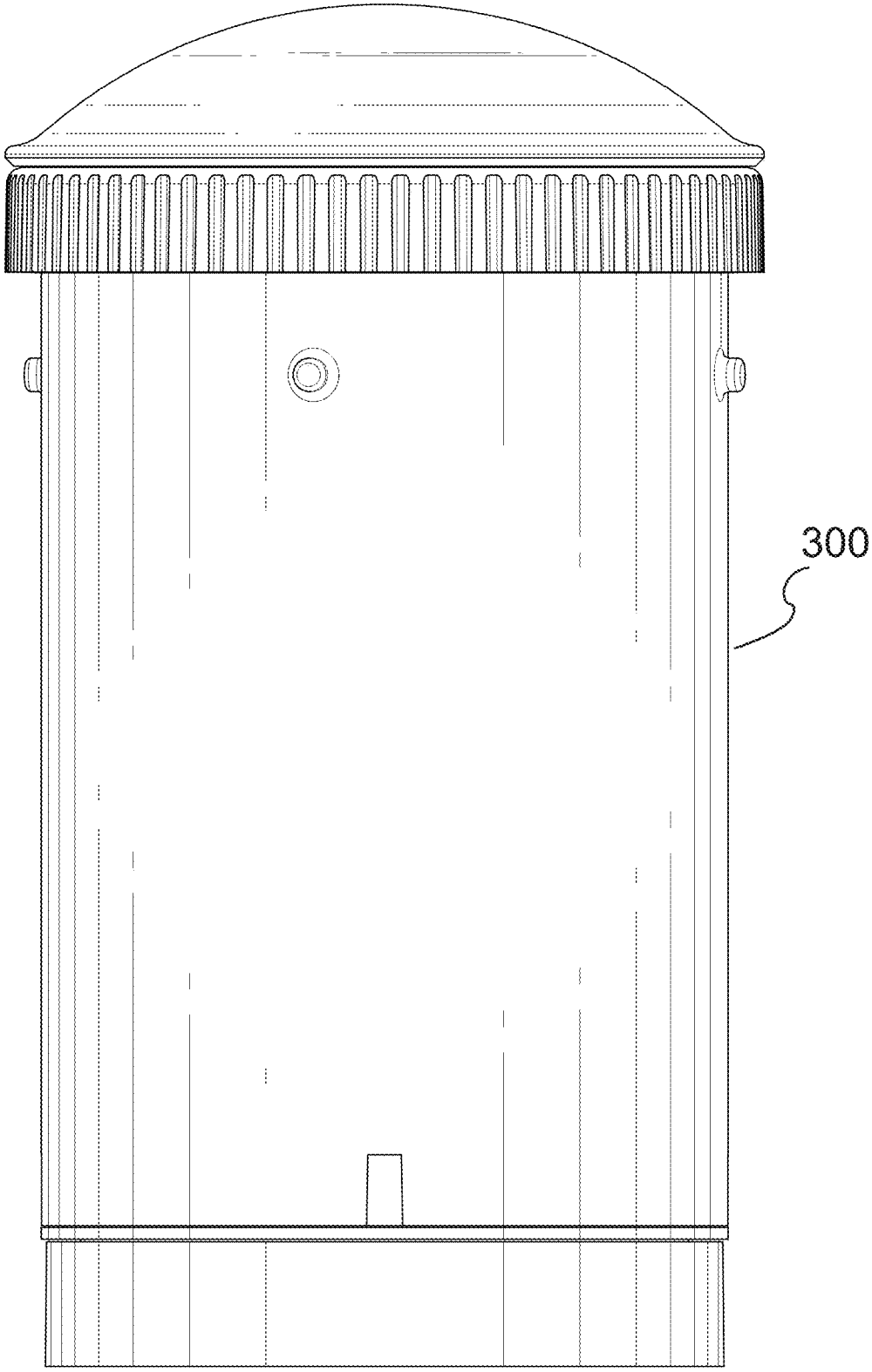
FIG. 16 shows a right side view of the replaceable deodorant cartridge according to the present invention, the left side view being a mirror image thereof.
Figure 17:
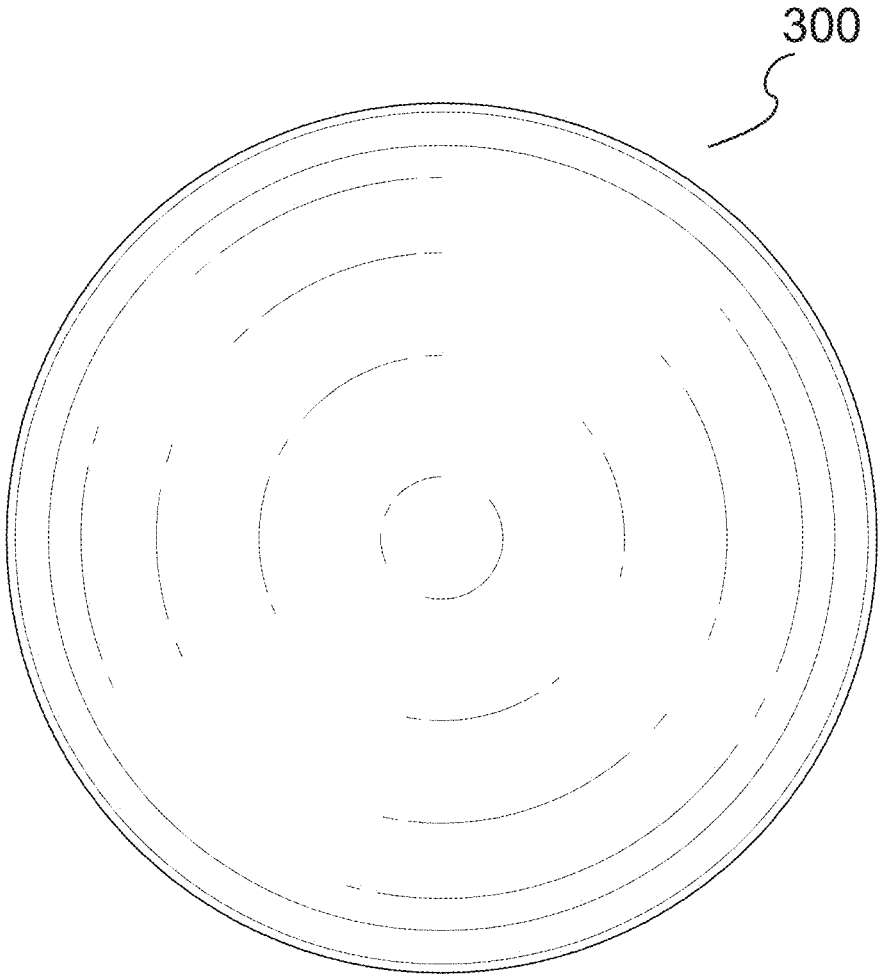
FIG. 17 shows a top view of the replaceable deodorant cartridge according to the present invention.
Figure 18:
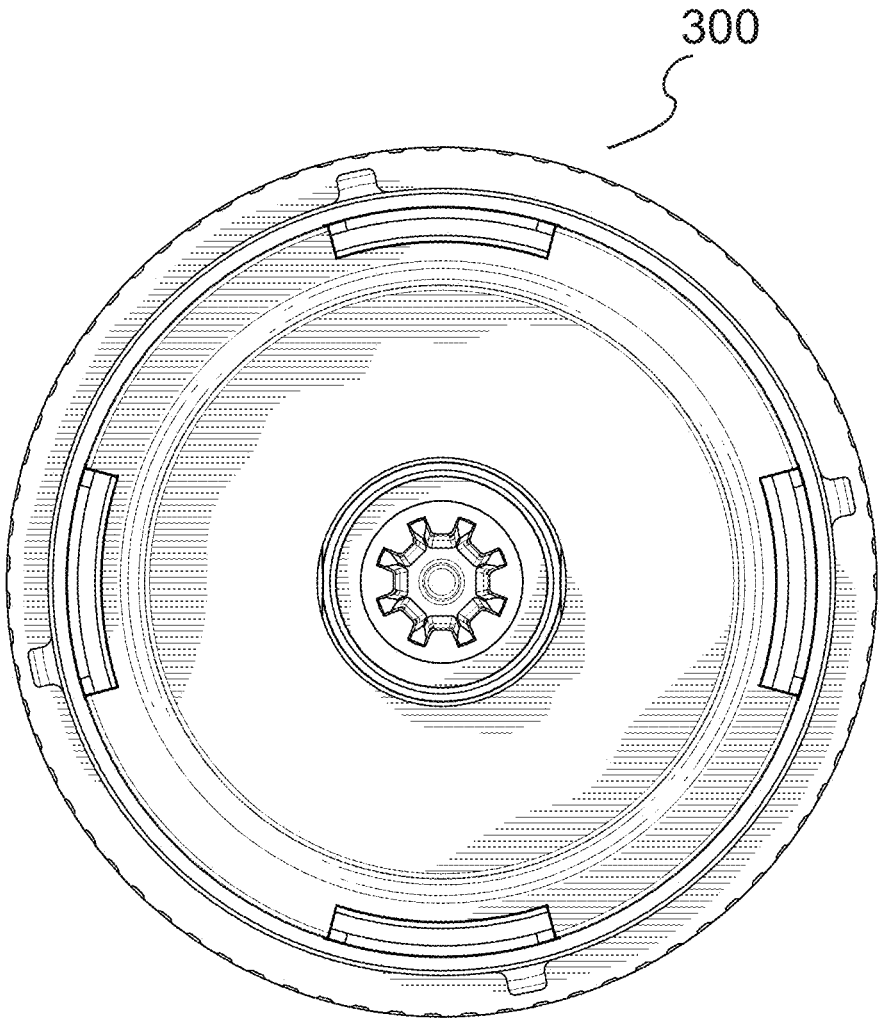
FIG. 18 shows a bottom view of the replaceable deodorant cartridge according to the present invention.
Figure 19:
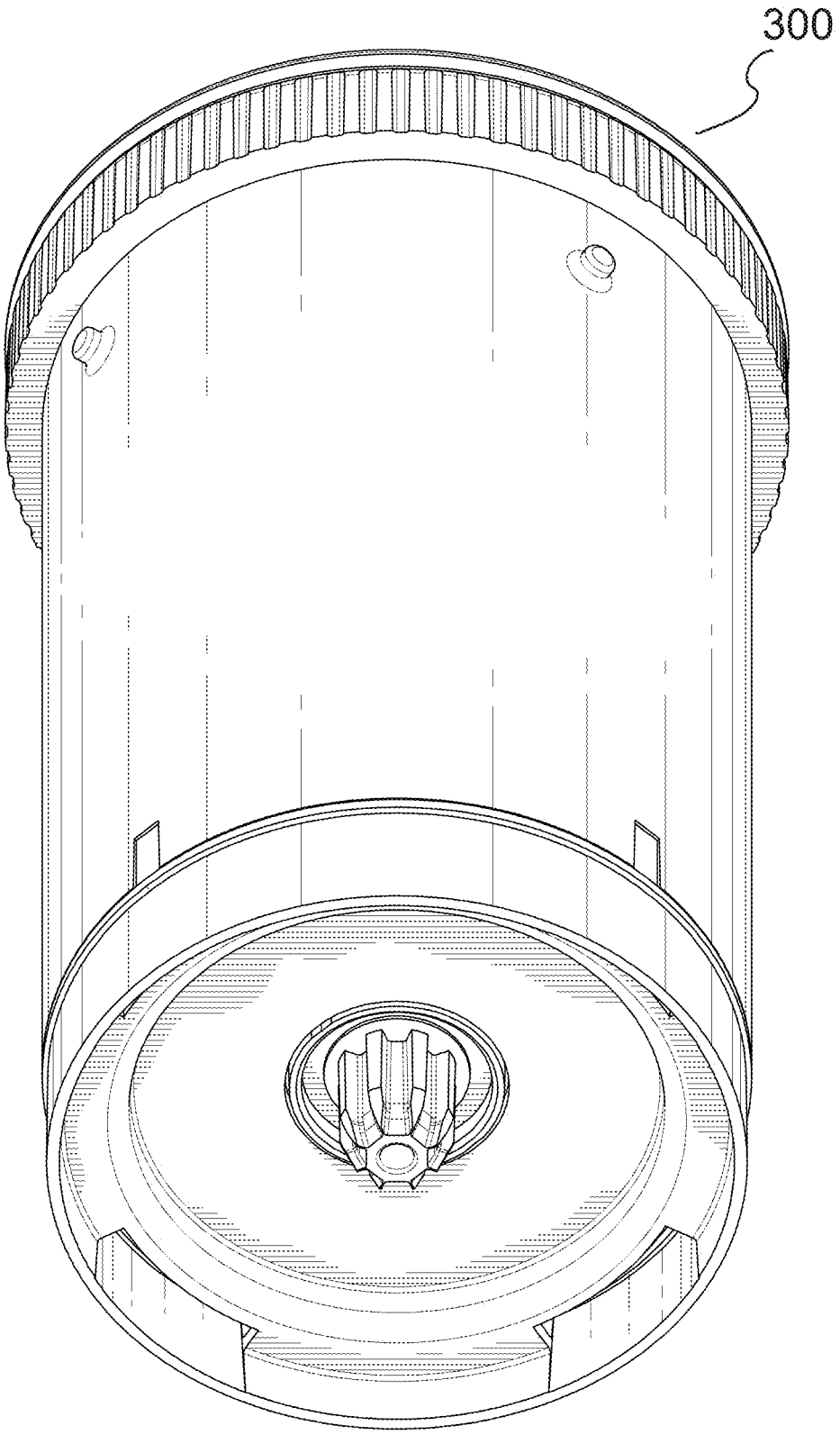
FIG. 19 shows a bottom perspective view of the outside of a replaceable deodorant cartridge according to the present invention.

Referring now to FIGS. 14 though 19, there is seen the outside appearance of the replaceable deodorant cartridge according to the present invention. FIG. 14 shows a front perspective view of a replaceable deodorant cartridge. FIG. 15 shows a front view of a replaceable deodorant cartridge, the back view being a mirror image thereof. FIG. 16 shows a right side view of the replaceable deodorant cartridge, the left side view being a mirror image thereof. FIG. 17 shows a top view of the replaceable deodorant cartridge and FIG. 18 shows a bottom view. FIG. 19 shows a bottom perspective view of the outside of a replaceable deodorant cartridge.

Figure 20:
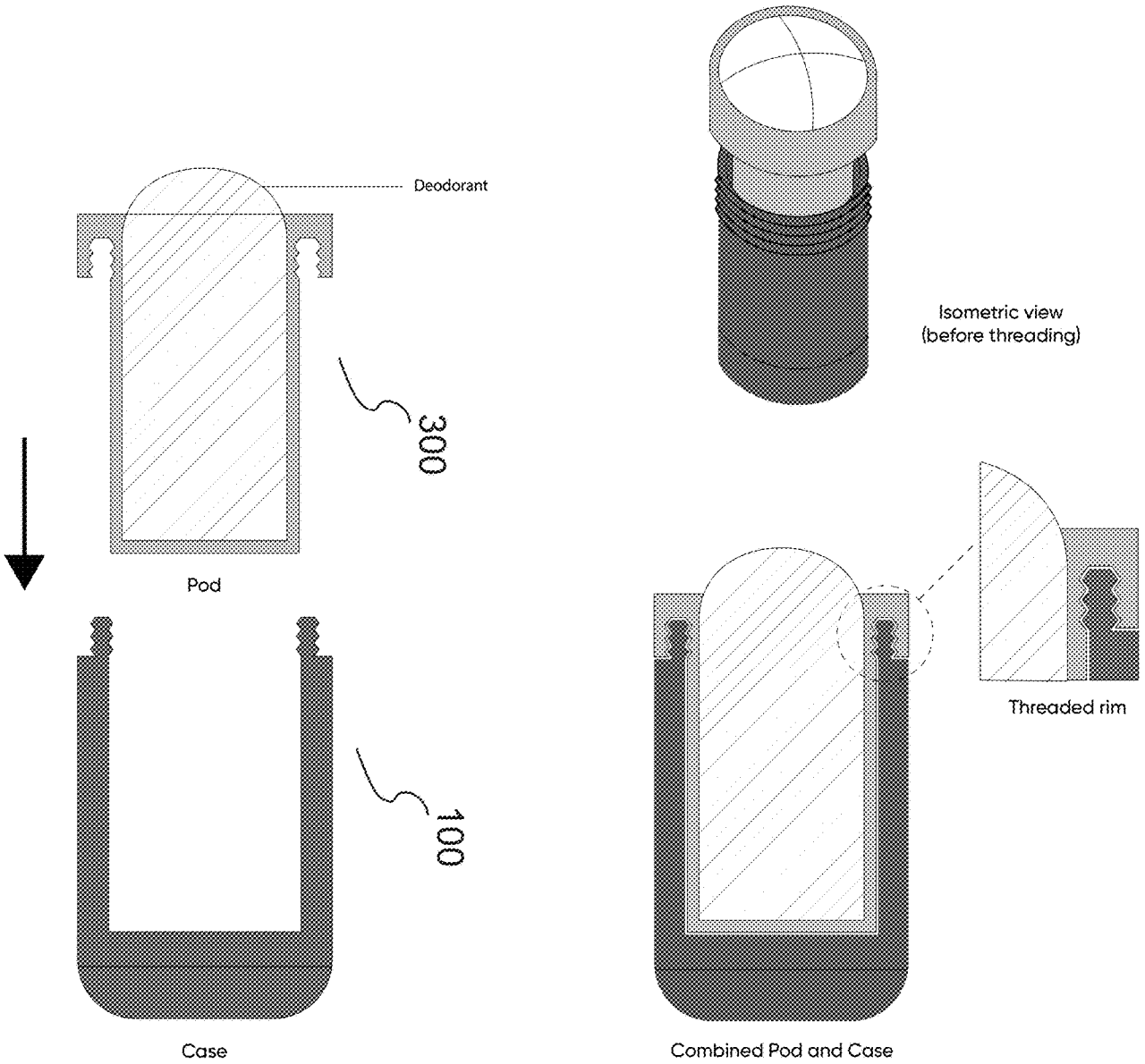
FIG. 20 shows an alternate mechanism to secure the replaceable deodorant cartridge inside the reusable deodorant case using a threaded connection.

FIG. 20 shows an alternate mechanism to secure the replaceable deodorant cartridge inside the reusable deodorant case using a threaded connection.

The invention includes deodorant dispensing system comprising:

a reusable deodorant case including a body having a distal end and an inner surface provided with at least one longitudinally extending cartridge-receipt groove, and a dial rotatably coupled to the distal end of the body; and a deodorant cartridge including a sleeve removeably positionable within the body of the deodorant case and having a distal end, a proximal end, a longitudinal length, an outer surface and an inner surface, the outer surface of the sleeve being provided with at least one guiding rail for slideably mating with the at least one cartridge-receipt groove on the inner surface of the body, the inner surface of the sleeve being provided with at least one guiding groove extending longitudinally from the distal end of the sleeve to a terminating end of the at least one guiding groove, a length of the at least one guiding groove being less than the longitudinal length of the sleeve;

a deodorant puck positioned within the sleeve;

a platform having a longitudinal bore provided with bore threads and at least one projecting tab for slideably mating with the at least one guiding groove of the sleeve;

a bottom cap having a longitudinal bore, the bottom cap being coupled to the distal end of the sleeve, and a cylindrical spindle having an outer surface provided with surface threads and an operating end structured to removeably couple to the dial of the deodorant case, the spindle extending through the longitudinal bore of the platform and the longitudinal bore of the bottom cap, the surface threads of the spindle screwably engaging the bore threads of the platform, wherein, when the deodorant cartridge is properly inserted within the body of the deodorant case, rotation of the dial along a first predetermined rotational direction operates to advance the platform toward the proximal end of the sleeve to dispense the deodorant puck until the at least one tab of the platform contacts the terminal end of the at least one guiding groove of the sleeve, and wherein further rotation of the dial along the first predetermined rotational direction after the at least one tab of the platform contacts the terminal end of the at least one guiding groove of the sleeve operates to at least partially eject the deodorant cartridge from the body of the deodorant case.

The invention is further a deodorant system as set forth above in paragraph 81, further comprising a removeable cover structured to be positioned over the proximal end of the sleeve for covering the deodorant puck.

The invention is further a deodorant system as set forth above in paragraph 81, wherein the outer surface of the sleeve is provided with at least one engagement rib and the inner surface of the body is provided with at least one mating rib structured to snap-fit with the at least one engagement rib for removeably maintaining the deodorant cartridge within the body.

The invention is further a deodorant system as set forth above in paragraph 81,

The invention is further a deodorant system of paragraph 81, wherein the reusable deodorant case further includes a positioning member fixedly coupled to the distal end of the body and enclosed by the dial, the positioning member being structured to bias the dial into a plurality of discrete rotational positions when the dial is rotated.

The invention is further a deodorant system of paragraph 84, wherein the positioning member includes at least one detent and at least one leaf-spring coupled to the at least one detent, and the dial includes an inner surface provided with a plurality of circumferentially positioned receptacles, wherein the at least one leaf-spring is structured to bias the at least one detent into a first one of the receptacles to position the dial into a first one of the plurality of discrete rotational positions, and wherein an inner surface of the first receptacle is structured to compress the leaf-spring when the dial is rotated to advance a second one of the receptacles to the detent, thereby positioning the dial into a second one of the plurality of discrete rotational positions.

The invention is further a deodorant system of paragraph 85, wherein the at least one detent is convex in shape and each of the plurality of receptacles is concave in shape.

The invention is further a deodorant system of paragraph 86, wherein interaction of the at least one detent with the plurality of receptacles produces a clicking sound when the dial is rotated.

The invention is further a deodorant system of paragraph 81, further comprising a top cap structured to removeably couple to a proximal end of the body of the deodorant case.

The invention is further a deodorant system of paragraph 88, wherein the top cap has an inner surface provided with a plurality of channels and the outer surface of the body at a proximal end of the body is provided with a respective plurality of protrusions for slideably engaging the plurality of channels, wherein the plurality of protrusions are advanced within the plurality of channels to bias the top cap in a closed position when the top cap is rotated along a second rotational direction, and the plurality of protrusions are retreated from the plurality of channels for removal of the top cap from the body when the top cap is rotated along a direction opposite to the second rotational direction.

The invention is further a reusable deodorant case for use with a deodorant cartridge, the deodorant cartridge including a sleeve having a distal end, a proximal end, a longitudinal length, an outer surface and an inner surface, the outer surface of the sleeve being provided with at least one guiding rail, the inner surface of the sleeve being provided with at least one guiding groove extending longitudinally from the distal end of the sleeve to a terminating end of the at least one guiding groove, a length of the at least one guiding groove being less than the longitudinal length of the sleeve; a deodorant puck positioned within the sleeve; a platform having a longitudinal bore provided with bore threads and at least one projecting tab for slideably mating with the at least one guiding groove of the sleeve; a bottom cap having a longitudinal bore, the bottom cap being coupled to the distal end of the sleeve, and a cylindrical spindle having an outer surface provided with surface threads and an operating end removably coupled to the dial of the deodorant case, the spindle extending through the longitudinal bore of the platform and the longitudinal bore of the bottom cap, the surface threads of the spindle screwably engaging the bore threads of the platform, the reusable deodorant case comprising:

a body having a distal end and an inner surface provided with at least one longitudinally extending cartridge-receipt groove structured to slideably receive the at least one guiding rail of the sleeve of the deodorant cartridge; and a dial rotatably coupled to the distal end of the body and structured to removably couple to the operating end of the spindle when the deodorant cartridge is positioned within the body.

The invention is further a reusable deodorant case of paragraph 90, wherein, when the deodorant cartridge is positioned within the body, rotation of the dial along a first predetermined rotational direction advances the platform of the deodorant cartridge toward the proximal end of the sleeve to dispense the deodorant puck until the at least one tab of the platform contacts the terminal end of the at least one guiding groove of the sleeve of the deodorant cartridge, and wherein further rotation of the dial along the first predetermined rotational direction after the at least one tab of the platform contacts the terminal end of the at least one guiding groove of the sleeve is operable to at least partially eject the deodorant cartridge from the body.

The invention is further a reusable deodorant case of paragraph 90, wherein the inner surface of the body is provided with at least one mating rib structured to snap-fit with at least one engagement rib provided on the outer surface of the sleeve of the deodorant cartridge for removeably maintaining the deodorant cartridge within the body.

The invention is further a reusable deodorant case of paragraph 90, further comprising a positioning member fixedly coupled to the distal end of the body and enclosed by the dial, the positioning member being structured to bias the dial into a plurality of discrete rotational positions as the dial is rotated.

The invention is further a reusable deodorant case of paragraph 93, wherein the positioning member includes at least one detent and at least one leaf-spring coupled to the at least one detent, and the dial includes an inner surface provided with a plurality of circumferentially positioned receptacles, wherein the at least one leaf-spring is structured to bias the at least one detent into a first one of the receptacles to position the dial into a first one of the plurality of discrete rotational positions, and wherein an inner surface of the first receptacle is structured to compress the leaf-spring when the dial is rotated to advance a second one of the receptacles to the detent, thereby positioning the dial into a second one of the plurality of discrete rotational positions.

The invention is further a reusable deodorant case of paragraph 94, wherein the at least one detent is convex in shape and each of the plurality of receptacles is concave in shape.

The invention is further a reusable deodorant case of paragraph 90, further comprising a top cap structured to removeably couple to a proximal end of the body.

The invention is further a reusable deodorant case of paragraph 96, wherein the top cap has an inner surface provided with a plurality of channels and the outer surface of the body at a proximal end of the body is provided with a respective plurality of protrusions slideably engaging the plurality of channels, wherein the plurality of protrusions are advanced within the plurality of channels to bias the top cap in a closed position when the top cap is rotated along a second rotational direction, and the plurality of protrusions are retreated from the plurality of channels for removal of the top cap from the body when the top cap is rotated along a direction opposite to the second rotational direction.

The invention is further a deodorant cartridge for use with a reusable deodorant case, the case having a body with at least one cartridge-receipt groove and a rotatable dial, the deodorant cartridge comprising:

a sleeve configured to be removeably positioned within the body of the deodorant case, the sleeve having a distal end, a proximal end, a longitudinal length, an outer surface and an inner surface, the outer surface of the sleeve being provided with at least one guiding rail for slideably mating with the at least one cartridge-receipt groove on the inner surface of the body, the inner surface of the sleeve being provided with at least one guiding groove extending longitudinally from the distal end of the sleeve to a terminating end of the at least one guiding groove, a length of the at least one guiding groove being less than the longitudinal length of the sleeve;

a deodorant puck positioned within the sleeve;

a platform having a longitudinal bore provided with bore threads and at least one projecting tab for slideably mating with the at least one guiding groove of the sleeve;

a bottom cap having a longitudinal bore, the bottom cap being coupled to the distal end of the sleeve; and a cylindrical spindle having an outer surface provided with surface threads and an operating end structured to removably couple to the dial of the deodorant case, the spindle extending through the longitudinal bore of the platform and the longitudinal bore of the bottom cap, the surface threads of the spindle screwably engaging the bore threads of the platform, wherein the platform is operable to advance toward the proximal end of the sleeve to dispense the deodorant puck when the spindle is rotated along a first predetermined rotational direction.

The invention is further a reusable deodorant case of paragraph 98, further comprising a removeable cover structured to be positioned over the proximal end of the sleeve for covering the deodorant puck.

The invention is further a reusable deodorant case of paragraph 98, wherein the outer surface of the sleeve is provided with at least one engagement rib structured to snap-fit with a mating rib of the body of the reusable deodorant case for removeably maintaining the sleeve within the body.

The invention is further a deodorant dispensing system, comprising:

a reusable deodorant case including a body having a distal end and an inner surface provided with at least one mating groove, a dial rotatably coupled to the distal end of the body, the dial including a clutch receipt structure, and a clutch positioned within the clutch receipt structure of the dial, the clutch including a spindle receipt structure; and a deodorant cartridge including a sleeve removeably positionable within the body of the deodorant case and having a distal end, a proximal end, a longitudinal length, an outer surface, an inner surface and a gripping rail, the outer surface of the sleeve being provided with at least one guiding tab for mating with the at least one mating groove of the body, the inner surface of the sleeve being provided with at least one guiding rail extending longitudinally from the distal end of the sleeve to a terminating widened stopper, a length of the at least one guiding rail being less than the longitudinal length of the sleeve, a deodorant puck positioned within the sleeve, a platform having a longitudinal bore provided with bore threads and at least one guiding groove for slideably mating with the at least one guiding rail of the sleeve, a bottom cap having a longitudinal bore, the bottom cap being coupled to the distal end of the sleeve, and a spindle having an outer surface provided with surface threads, an operating end structured to removeably couple to the spindle receipt structure of the clutch, and an operating disc formed integrally with the operating end, the spindle extending through the longitudinal bore of the platform and the longitudinal bore of the bottom cap, the surface threads of the spindle screwably engaging the bore threads of the platform, wherein, when the deodorant cartridge is properly inserted within the body of the deodorant case, rotation of the dial along a first predetermined rotational direction operates to advance the platform toward the proximal end of the sleeve to dispense the deodorant puck, and wherein rotation of the dial along a rotational direction opposite to the first predetermined rotational direction operates to retract the platform toward the distal end of the sleeve to retract the deodorant puck.

The invention is further a deodorant system of paragraph 101, further comprising a removeable cover structured to be positioned over the proximal end of the sleeve for covering the deodorant puck, the removable cover including a lip to facilitate easy gripping by a user.

The invention is further a deodorant system of paragraph 101, wherein the at least one guiding tab of the sleeve is advanced within the at least one mating grove of the body to bias the deodorant cartridge in an inserted position when the deodorant cartridge is rotated along a second rotational direction, and the at least one guiding tab of the sleeve is retreated from the at least one mating grove of the body for removal of the deodorant cartridge from the body when the deodorant cartridge is rotated along a direction opposite to the second rotational direction.

The invention is further a deodorant system of paragraph 101, wherein the reusable deodorant case further includes a positioning member fixedly coupled to the distal end of the body and enclosed by the dial, the positioning member being structured to bias the dial into a plurality of discrete rotational positions when the dial is rotated.

The invention is further a deodorant system of paragraph 104, wherein the positioning member includes at least one detent and at least one leaf-spring coupled to the at least one detent, and the dial includes an inner surface provided with a plurality of circumferentially positioned receptacles, wherein the at least one leaf-spring is structured to bias the at least one detent into a first one of the receptacles to position the dial into a first one of the plurality of discrete rotational positions, and wherein an inner surface of the first receptacle is structured to compress the leaf-spring when the dial is rotated to advance a second one of the receptacles to the detent, thereby positioning the dial into a second one of the plurality of discrete rotational positions.

The invention is further a deodorant system of paragraph 105, wherein the at least one detent is convex in shape and each of the plurality of receptacles is concave in shape.

The invention is further a deodorant system of paragraph 106, wherein interaction of the at least one detent with the plurality of receptacles produces a clicking sound when the dial is rotated.

The invention is further a deodorant system of paragraph 101, further comprising a top cap structured to removeably couple to a proximal end of the body of the deodorant case.

The invention is further a deodorant system of paragraph 108, wherein the top cap has an inner surface provided with a plurality of channels and the outer surface of the body at a proximal end of the body is provided with a respective plurality of protrusions for slideably engaging the plurality of channels, wherein the plurality of protrusions are advanced within the plurality of channels to bias the top cap in a closed position when the top cap is rotated along a second rotational direction, and the plurality of protrusions are retreated from the plurality of channels for removal of the top cap from the body when the top cap is rotated along a direction opposite to the second rotational direction.

The invention is further a deodorant system of paragraph 101, wherein, when the platform is retracted fully toward the distal end of the sleeve and the dial is rotated along a rotational direction opposite to the first predetermined rotational direction, the clutch is structured to cause the dial to rotate freely with respect to the body and without causing rotation of the spindle.

The invention is further a deodorant system of paragraph 110, wherein the clutch includes at least one biasing leaf having a clutch tab and the clutch receipt structure of the dial includes at least one dial rib, the dial rib engaging the clutch tab when the dial is rotated.

The invention is further a deodorant system of paragraph 111, wherein, when the platform is retracted fully toward the distal end of the sleeve and the dial is rotated along a rotational direction opposite to the first predetermined rotational direction, the dial rib urges biasing leafs inwardly toward a center of the clutch until the clutch tab clears the dial rib, thereby permitting free rotation of the dial.

The invention is further a reusable deodorant case for use with a deodorant cartridge, the deodorant cartridge including a sleeve having a distal end, a proximal end, a longitudinal length, an outer surface, an inner surface and a gripping rail, the outer surface of the sleeve being provided with at least one guiding tab, the inner surface of the sleeve being provided with at least one guiding rail extending longitudinally from the distal end of the sleeve to a terminating widened stopper, a length of the at least one guiding rail being less than the longitudinal length of the sleeve; a deodorant puck positioned within the sleeve; a platform having a longitudinal bore provided with bore threads and at least one guiding groove for slideably mating with the at least one guiding rail of the sleeve; a bottom cap having a longitudinal bore, the bottom cap being coupled to the distal end of the sleeve; and a spindle having an outer surface provided with surface threads, an operating end, and an operating disc formed integrally with the operating end, the spindle extending through the longitudinal bore of the platform and the longitudinal bore of the bottom cap, the surface threads of the spindle screwably engaging the bore threads of the platform, the reusable deodorant case comprising:

a body having a distal end and an inner surface provided with at least one mating groove for mating with the at least one guiding tab of the sleeve of the deodorant cartridge;

a dial rotatably coupled to the distal end of the body, the dial including a clutch receipt structure; and a clutch positioned within the clutch receipt structure of the dial, the clutch including a spindle receipt structure structured to mate with the operating end of the spindle of the deodorant cartridge, wherein, when the deodorant cartridge is properly inserted within the body, rotation of the dial along a first predetermined rotational direction operates to advance the platform toward the proximal end of the sleeve to dispense the deodorant puck, and wherein rotation of the dial along a rotational direction opposite to the first predetermined rotational direction operates to retract the platform toward the distal end of the sleeve to retract the deodorant puck.

The invention is further a reusable deodorant case of paragraph 113, wherein the reusable deodorant case further includes a positioning member fixedly coupled to the distal end of the body and enclosed by the dial, the positioning member being structured to bias the dial into a plurality of discrete rotational positions when the dial is rotated.

The invention is further a reusable deodorant case of paragraph 114, wherein the positioning member includes at least one detent and at least one leaf-spring coupled to the at least one detent, and the dial includes an inner surface provided with a plurality of circumferentially positioned receptacles, wherein the at least one leaf-spring is structured to bias the at least one detent into a first one of the receptacles to position the dial into a first one of the plurality of discrete rotational positions, and wherein an inner surface of the first receptacle is structured to compress the leaf-spring when the dial is rotated to advance a second one of the receptacles to the detent, thereby positioning the dial into a second one of the plurality of discrete rotational positions.

The invention is further a reusable deodorant case of paragraph 115, wherein the at least one detent is convex in shape and each of the plurality of receptacles is concave in shape.

The invention is further a reusable deodorant case of paragraph 116, wherein interaction of the at least one detent with the plurality of receptacles produces a clicking sound when the dial is rotated.

The invention is further a reusable deodorant case of paragraph 113, further comprising a top cap structured to removeably couple to a proximal end of the body of the deodorant case.

The invention is further a reusable deodorant case of paragraph 113, wherein, when the deodorant cartridge is positioned within the body with the platform retracted fully toward the distal end of the sleeve and the dial is rotated along a rotational direction opposite to the first predetermined rotational direction, the clutch is structured to cause the dial to rotate freely with respect to the body and without causing rotation of the spindle.

The invention is further a reusable deodorant case of paragraph 119, wherein the clutch includes at least one biasing leaf having a clutch tab and the clutch receipt structure of the dial includes at least one dial rib, the dial rib engaging the clutch tab when the dial is rotated.

The invention is further a reusable deodorant case of paragraph 120, wherein, when the deodorant cartridge is positioned within the body with the platform retracted fully toward the distal end of the sleeve and the dial is rotated along a rotational direction opposite to the first predetermined rotational direction, the dial rib urges biasing leafs inwardly toward a center of the clutch until the clutch tab clears the dial rib, thereby permitting free rotation of the dial.

While the present invention has been illustrated by description of various embodiments and while those embodiments have been described in considerable detail, it is not the intention of Applicant to restrict or in any way limit the scope of the invention to such details. Additional advantages and modifications will readily appear to those skilled in the art. The invention in its broader aspects is therefore not limited to the specific details and illustrative examples shown and described. Departures may be made from such details without departing from the spirit or scope of the invention.

We claim:

1. A deodorant dispensing system, comprising:

a reusable deodorant case including a body having a distal end and an inner surface provided with at least one mating groove, a dial rotatably coupled to the distal end of the body, the dial including a clutch receipt structure, and a clutch positioned within the clutch receipt structure of the dial, the clutch including a spindle receipt structure; and a deodorant cartridge including a sleeve removeably positionable within the body of the deodorant case and having a distal end, a proximal end, a longitudinal length, an outer surface, an inner surface and a gripping rail, the outer surface of the sleeve being provided with at least one guiding tab for mating with the at least one mating groove of the body, the inner surface of the sleeve being provided with at least one guiding rail extending longitudinally from the distal end of the sleeve to a terminating widened stopper, a length of the at least one guiding rail being less than the longitudinal length of the sleeve, a deodorant puck positioned within the sleeve, a platform having a longitudinal bore provided with bore threads and at least one guiding groove for slideably mating with the at least one guiding rail of the sleeve, a bottom cap having a longitudinal bore, the bottom cap being coupled to the distal end of the sleeve, and a spindle having an outer surface provided with surface threads, an operating end structured to removeably couple to the spindle receipt structure of the clutch, and an operating disc formed integrally with the operating end, the spindle extending through the longitudinal bore of the platform and the longitudinal bore of the bottom cap, the surface threads of the spindle screwably engaging the bore threads of the platform, wherein, when the deodorant cartridge is properly inserted within the body of the deodorant case, rotation of the dial along a first predetermined rotational direction operates to advance the platform toward the proximal end of the sleeve to dispense the deodorant puck, and wherein rotation of the dial along a rotational direction opposite to the first predetermined rotational direction operates to retract the platform toward the distal end of the sleeve to retract the deodorant puck.

2. The deodorant system of claim 1, further comprising a removeable cover structured to be positioned over the proximal end of the sleeve for covering the deodorant puck, the removable cover including a lip to facilitate easy gripping by a user.

3. The deodorant system of claim 1, wherein the at least one guiding tab of the sleeve is advanced within the at least one mating grove of the body to bias the deodorant cartridge in an inserted position when the deodorant cartridge is rotated along a second rotational direction, and the at least one guiding tab of the sleeve is retreated from the at least one mating grove of the body for removal of the deodorant cartridge from the body when the deodorant cartridge is rotated along a direction opposite to the second rotational direction.

4. The deodorant system of claim 1, wherein the reusable deodorant case further includes a positioning member fixedly coupled to the distal end of the body and enclosed by the dial, the positioning member being structured to bias the dial into a plurality of discrete rotational positions when the dial is rotated.

5. The deodorant system of claim 4, wherein the positioning member includes at least one detent and at least one leaf-spring coupled to the at least one detent, and the dial includes an inner surface provided with a plurality of circumferentially positioned receptacles, wherein the at least one leaf-spring is structured to bias the at least one detent into a first one of the receptacles to position the dial into a first one of the plurality of discrete rotational positions, and wherein an inner surface of the first receptacle is structured to compress the leaf-spring when the dial is rotated to advance a second one of the receptacles to the detent, thereby positioning the dial into a second one of the plurality of discrete rotational positions.

6. The deodorant system of claim 5, wherein the at least one detent is convex in shape and each of the plurality of receptacles is concave in shape.

7. The deodorant system of claim 6, wherein interaction of the at least one detent with the plurality of receptacles produces a clicking sound when the dial is rotated.

8. The deodorant system of claim 1, further comprising a top cap structured to removeably couple to a proximal end of the body of the deodorant case.

9. The deodorant system of claim 8, wherein the top cap has an inner surface provided with a plurality of channels and the outer surface of the body at a proximal end of the body is provided with a respective plurality of protrusions for slideably engaging the plurality of channels, wherein the plurality of protrusions are advanced within the plurality of channels to bias the top cap in a closed position when the top cap is rotated along a second rotational direction, and the plurality of protrusions are retreated from the plurality of channels for removal of the top cap from the body when the top cap is rotated along a direction opposite to the second rotational direction.

10. The deodorant system of claim 1, wherein, when the platform is retracted fully toward the distal end of the sleeve and the dial is rotated along a rotational direction opposite to the first predetermined rotational direction, the clutch is structured to cause the dial to rotate freely with respect to the body and without causing rotation of the spindle.

11. The deodorant system of claim 10, wherein the clutch includes at least one biasing leaf having a clutch tab and the clutch receipt structure of the dial includes at least one dial rib, the dial rib engaging the clutch tab when the dial is rotated.

12. The deodorant system of claim 11, wherein, when the platform is retracted fully toward the distal end of the sleeve and the dial is rotated along a rotational direction opposite to the first predetermined rotational direction, the dial rib urges biasing leafs inwardly toward a center of the clutch until the clutch tab clears the dial rib, thereby permitting free rotation of the dial.

13. A reusable deodorant case for use with a deodorant cartridge, the deodorant cartridge including a sleeve having a distal end, a proximal end, a longitudinal length, an outer surface, an inner surface and a gripping rail, the outer surface of the sleeve being provided with at least one guiding tab, the inner surface of the sleeve being provided with at least one guiding rail extending longitudinally from the distal end of the sleeve to a terminating widened stopper, a length of the at least one guiding rail being less than the longitudinal length of the sleeve; a deodorant puck positioned within the sleeve; a platform having a longitudinal bore provided with bore threads and at least one guiding groove for slideably mating with the at least one guiding rail of the sleeve; a bottom cap having a longitudinal bore, the bottom cap being coupled to the distal end of the sleeve; and a spindle having an outer surface provided with surface threads, an operating end, and an operating disc formed integrally with the operating end, the spindle extending through the longitudinal bore of the platform and the longitudinal bore of the bottom cap, the surface threads of the spindle screwably engaging the bore threads of the platform, the reusable deodorant case comprising:

a body having a distal end and an inner surface provided with at least one mating groove for mating with the at least one guiding tab of the sleeve of the deodorant cartridge;

a dial rotatably coupled to the distal end of the body, the dial including a clutch receipt structure; and a clutch positioned within the clutch receipt structure of the dial, the clutch including a spindle receipt structure structured to mate with the operating end of the spindle of the deodorant cartridge, wherein, when the deodorant cartridge is properly inserted within the body, rotation of the dial along a first predetermined rotational direction operates to advance the platform toward the proximal end of the sleeve to dispense the deodorant puck, and wherein rotation of the dial along a rotational direction opposite to the first predetermined rotational direction operates to retract the platform toward the distal end of the sleeve to retract the deodorant puck.

14. The reusable deodorant case of claim 13, wherein the reusable deodorant case further includes a positioning member fixedly coupled to the distal end of the body and enclosed by the dial, the positioning member being structured to bias the dial into a plurality of discrete rotational positions when the dial is rotated.

15. The reusable deodorant case of claim 14, wherein the positioning member includes at least one detent and at least one leaf-spring coupled to the at least one detent, and the dial includes an inner surface provided with a plurality of circumferentially positioned receptacles, wherein the at least one leaf-spring is structured to bias the at least one detent into a first one of the receptacles to position the dial into a first one of the plurality of discrete rotational positions, and wherein an inner surface of the first receptacle is structured to compress the leaf-spring when the dial is rotated to advance a second one of the receptacles to the detent, thereby positioning the dial into a second one of the plurality of discrete rotational positions.

16. The reusable deodorant case of claim 15, wherein the at least one detent is convex in shape and each of the plurality of receptacles is concave in shape.

17. The reusable deodorant case of claim 16, wherein interaction of the at least one detent with the plurality of receptacles produces a clicking sound when the dial is rotated.

18. The reusable deodorant case of clam 13, further comprising a top cap structured to removeably couple to a proximal end of the body of the deodorant case.

19. The reusable deodorant case of clam 13, wherein, when the deodorant cartridge is positioned within the body with the platform retracted fully toward the distal end of the sleeve and the dial is rotated along a rotational direction opposite to the first predetermined rotational direction, the clutch is structured to cause the dial to rotate freely with respect to the body and without causing rotation of the spindle.

20. The reusable deodorant case of clam 19, wherein the clutch includes at least one biasing leaf having a clutch tab and the clutch receipt structure of the dial includes at least one dial rib, the dial rib engaging the clutch tab when the dial is rotated.

21. The reusable deodorant case of clam 20, wherein, when the deodorant cartridge is positioned within the body with the platform retracted fully toward the distal end of the sleeve and the dial is rotated along a rotational direction opposite to the first predetermined rotational direction, the dial rib urges biasing leafs inwardly toward a center of the clutch until the clutch tab clears the dial rib, thereby permitting free rotation of the dial.

22. A deodorant dispensing system, comprising:

a reusable deodorant case including a body having a distal end and an inner surface provided with at least one longitudinally extending cartridge-receipt groove, and a dial rotatably coupled to the distal end of the body; and a deodorant cartridge including a sleeve removeably positionable within the body of the deodorant case and having a distal end, a proximal end, a longitudinal length, an outer surface and an inner surface, the outer surface of the sleeve being provided with at least one guiding rail for slideably mating with the at least one cartridge-receipt groove on the inner surface of the body, the inner surface of the sleeve being provided with at least one guiding groove extending longitudinally from the distal end of the sleeve to a terminating end of the at least one guiding groove, a length of the at least one guiding groove being less than the longitudinal length of the sleeve;

a deodorant puck positioned within the sleeve;

a platform having a longitudinal bore provided with bore threads and at least one projecting tab for slideably mating with the at least one guiding groove of the sleeve;

a bottom cap having a longitudinal bore, the bottom cap being coupled to the distal end of the sleeve, and a cylindrical spindle having an outer surface provided with surface threads and an operating end structured to removeably couple to the dial of the deodorant case, the spindle extending through the longitudinal bore of the platform and the longitudinal bore of the bottom cap, the surface threads of the spindle screwably engaging the bore threads of the platform, wherein, when the deodorant cartridge is properly inserted within the body of the deodorant case, rotation of the dial along a first predetermined rotational direction operates to advance the platform toward the proximal end of the sleeve to dispense the deodorant puck until the at least one tab of the platform contacts the terminal end of the at least one guiding groove of the sleeve, and wherein further rotation of the dial along the first predetermined rotational direction after the at least one tab of the platform contacts the terminal end of the at least one guiding groove of the sleeve operates to at least partially eject the deodorant cartridge from the body of the deodorant case.

* * * * *